US009440447B1

(12) United States Patent
Maeshima

(10) Patent No.: US 9,440,447 B1
(45) Date of Patent: Sep. 13, 2016

(54) INK CONTAINER AND INKJET IMAGE FORMING APPARATUS

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/059,923

(22) Filed: Mar. 3, 2016

(30) Foreign Application Priority Data

Mar. 9, 2015 (JP) ..... 2015-045753

(51) Int. Cl.
*B41J 2/175* (2006.01)

(52) U.S. Cl.
CPC ..... *B41J 2/17513* (2013.01)

(58) Field of Classification Search
CPC ..... B41J 2/17503; B41J 2/17506; B41J 2/17509; B41J 2/17513; B41J 2/1752; B41J 2/17523; B41J 2/17526; B41J 2/1753; B41J 2/17533; B41J 2/17536; B41J 2/1754; B41J 2/17543; B41J 2/17546; B41J 2/1755; B41J 2/17553; B41J 2/17556; B41J 2/17559; B41J 2002/17516
See application file for complete search history.

(56) References Cited

U.S. PATENT DOCUMENTS

2007/0652773 * 3/2007 Kawamura ..... B41J 2/17513 347/86
2012/0162329 A1* 6/2012 Mizuno ..... B41J 2/17513 347/86
2012/0218357 A1* 8/2012 Chen ..... B41J 2/17513 347/86

FOREIGN PATENT DOCUMENTS

JP 2010-082994 A 4/2010

* cited by examiner

*Primary Examiner* — Kristal Feggins
(74) *Attorney, Agent, or Firm* — Studebaker & Brackett PC

(57) ABSTRACT

An ink container includes an ink pack filled with an ink and a container case housing the ink pack. The container case includes an upper plate and a lower plate respectively covering the ink pack, one side plate provided between side parts of the upper plate and the lower plate, and two hinges coupling the upper plate and the lower plate with the side plate. The upper plate, the lower plate, the side plate and the hinges are integrally molded. The upper plate, the lower plate and the side plate are bent by the hinges so as to be thereby assembled as the container case including a housing configured to house the ink pack at a center. One ends of the upper plate and the lower plate constitute a grip and other ends of the upper plate and the lower plate constitutes an aperture.

13 Claims, 21 Drawing Sheets

INK CONTAINER AND INKJET IMAGE FORMING APPARATUS

INCORPORATION BY REFERENCE

This application is based on and claims the benefit of priority from Japanese Patent application No. 2015-045753 filed on Mar. 9, 2015, the entire contents of which are incorporated herein by reference.

BACKGROUND

The present disclosure relates to an ink container and an inkjet image forming apparatus including the ink container.

There is an inkjet image forming apparatus in which an ink container housing an ink pack filled with ink is attached, the ink is supplied from the ink container to a recording head, and the ink is ejected from the recording head to a sheet to thereby form an image on a surface of the sheet.

As one example, as shown in FIG. 20 and FIG. 21, an ink container 101 is composed of an ink pack 102 filled with ink and a container case 103 housing the ink pack 102. The ink pack 102 is configured so that a film member having elasticity is formed in a bag-like shape in which a gusset is provided, whereby when the ink is charged, the ink pack 102 is inflated, whereas when the ink is used and decreases in quantity, the ink pack 102 is contracted.

For example, there is an ink cartridge (ink container) including a liquid storage container (ink pack) in which ink is to be sealed and a box-shaped exterior body (container case) into which the liquid storage container is to be inserted, wherein an engaging face is arranged at one end of the exterior body and a supply port to be engaged with a side of a printer (image forming apparatus) is provided on the engaging face. On a bottom face opposite to the engaging face of the exterior body, a depression which is a grip at the time of pulling out the ink cartridge is formed. The engaging face is made of a hard material including plastics or the like, and the exterior body is made of a soft material including paper or the like. In this manner, while an increase of manufacturing costs is prevented, an environmental load is reduced, and operability at the time of attachment/detachment is improved. Incidentally, the liquid storage container is formed to have four faces by bonding four films with thermal welding, and on the left and right side faces, folds which are parallel to each other in the insertion direction with respect to the exterior body are formed. In addition, the liquid storage container collapses in accordance with the folds as the ink flows out, and converges on a horizontal face including terminal ends which are bonded with each other by thermal welding of the films.

In the ink container like the abovementioned ink cartridge, although the container case is made of paper, the engaging face or the supply port which is a connection portion to the image forming apparatus is made of plastics. In this case, depending on the strength of the case, the engaging face and the supply port each cannot be mounted to an appropriate position of the exterior body, and it becomes thereby difficult to attach the ink container to the image forming apparatus. Further, in the paper-made container case, if the case is wetted with ink, the strength lowers, and reuse or recycling becomes impossible. Also, in a case where the ink container with the ink pack being housed therein is transported, the paper-made container case does not have a suitable strength for transportation, and is easily damaged; and therefore, a packing member or a buffering member is required, thus increasing transportation costs. In addition, if the container case is made of a material having a suitable strength for transportation, material costs increase.

Further, similarly to the abovementioned ink cartridge, in the ink container 101 shown in FIG. 20 and FIG. 21, if the ink decreases in quantity, the ink pack 102 with folds being provided on both side faces thereof deforms so as to contract in the vertical direction and expands in the longitudinal direction. However, this ink container 101 is formed to adapt a length of the container case 103 to a length of the ink pack 102 in an inflated state thereof. Therefore, even if the ink pack 102 is about to deform with the decrease of the ink, an end of the ink pack 102 abuts against an interior wall of the container case 103 and thus expansion of the ink pack 102 is prevented (refer to FIG. 17). Accordingly, an inflated part is left in the ink pack 102, and the ink still remains in the thus inflated part; and hence, there is also a problem that the ink cannot be fully used up.

SUMMARY

In accordance with the present disclosure, an ink container includes an ink pack and a container case. The ink pack is filled with an ink. The container case houses the ink pack. The container case includes an upper plate and a lower plate, at least one side plate and at least two hinges. The upper plate and the lower plate respectively cover the ink pack from an upper side and a lower side. The side plate is provided between side parts of the upper plate and the lower plate. The hinges couple the upper plate and the lower plate with the side plate to each other. The upper plate, the lower plate, the side plate and the hinges are integrally molded. The upper plate, the lower plate and the side plate are bent by the hinges so as to be thereby assembled as the container case including a housing configured to house the ink pack at a center. One ends of the upper plate and the lower plate constitute a grip and other ends of the upper plate and the lower plate constitutes an aperture.

Furthermore, in accordance with the present disclosure, an inkjet image forming apparatus includes the ink container mentioned above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, embodiments of the present disclosure will be described with reference the drawings. Hereinafter, for the sake of convenience of the description, a near side on a paper sheet of FIG. 1 and FIG. 2 will be described as a front side of a printer 1 and arrows Fr shown in the figures indicate the front side of the printer 1.

First, with reference to FIG. 1 to FIG. 4, the entire structure of an inkjet color printer 1 (hereinafter, called as the "printer 1") as an inkjet image forming apparatus will be described.

Figure 1:
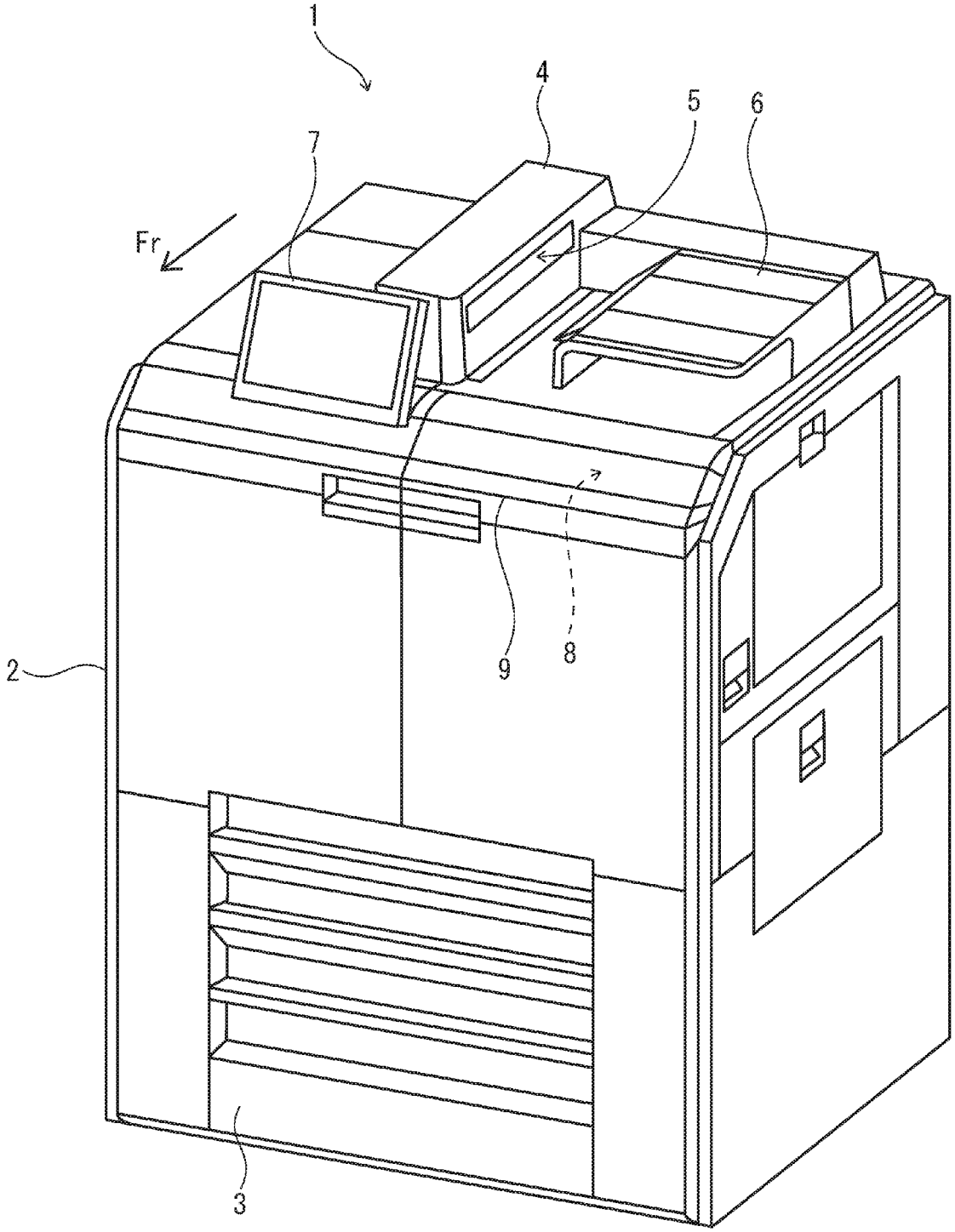
FIG. 1 is a perspective view showing a printer according to an embodiment of the present disclosure.
Figure 2:
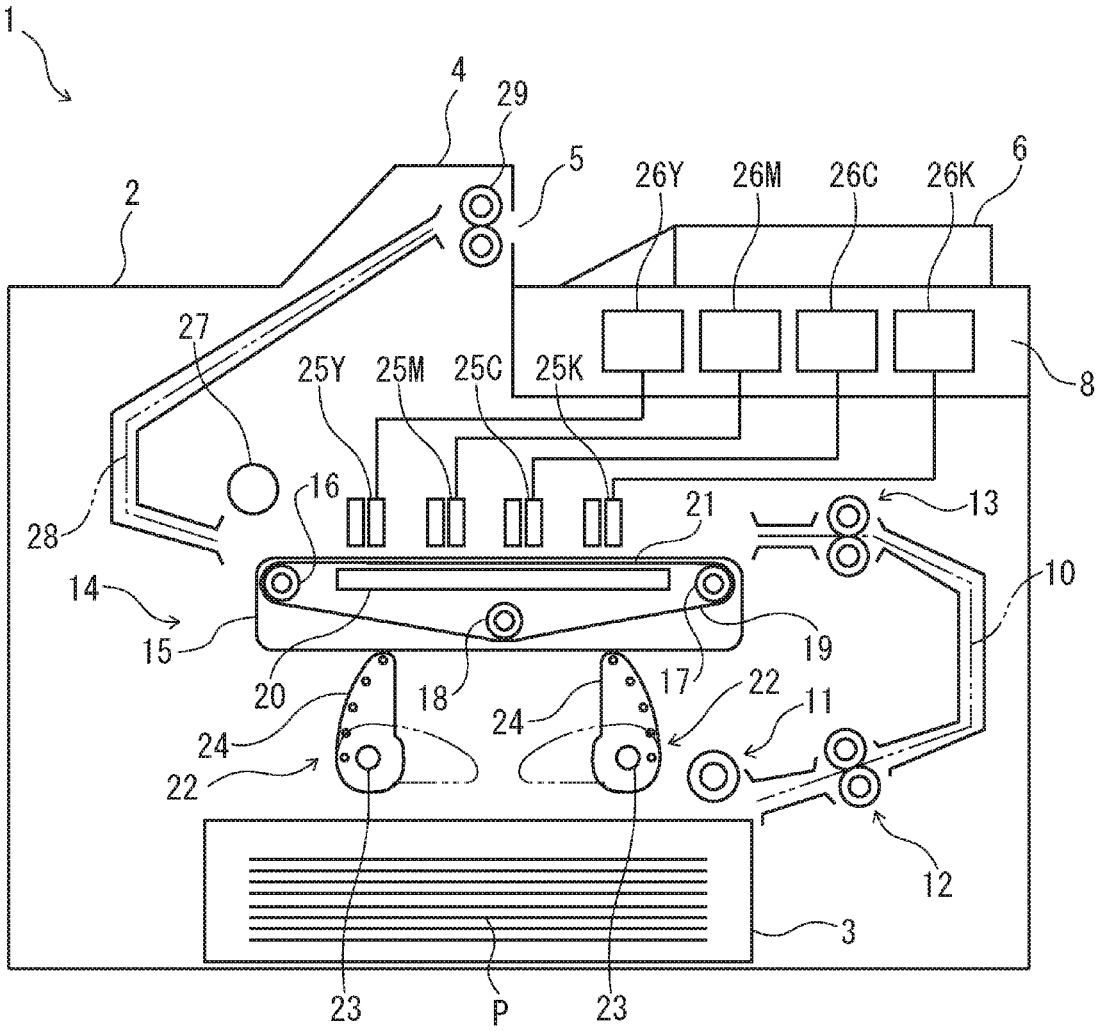
FIG. 2 is a sectional view showing an internal structure of the printer according to the embodiment of the present disclosure.

As shown in FIGS. 1 and 2, the printer 1 includes a box-formed printer main body 2. In a lower part of the printer main body 2, a plurality of sheet feeding cartridges 3 storing sheets P are installed pullably. In FIG. 1, the plurality of sheet feeding cartridges 3 are illustrated, while, in FIG. 2, one sheet feeding cartridge 3 is illustrated and other sheet feeding cartridges 3 are omitted for the sake of convenience of the description.

Figure 3:
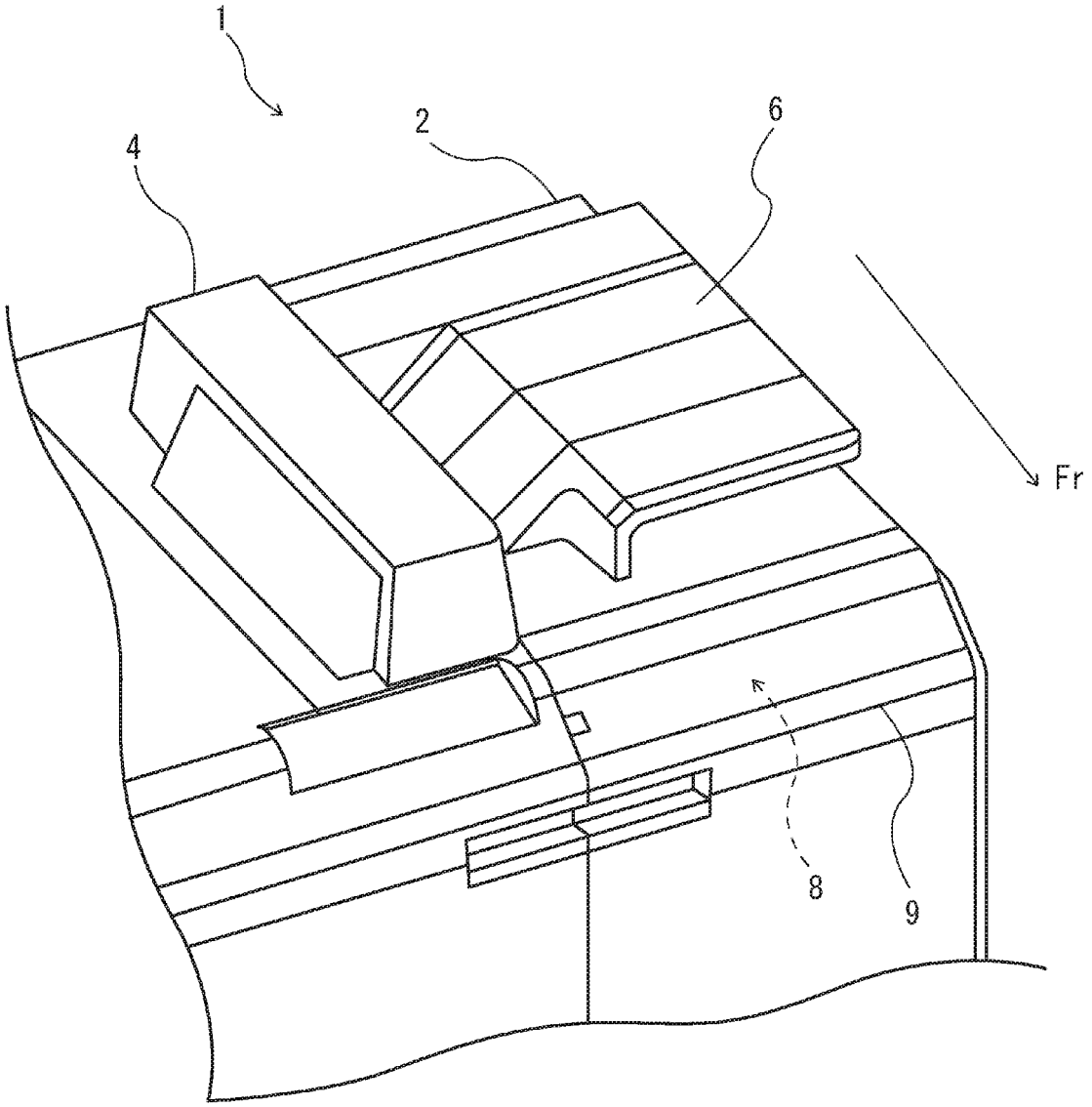
FIG. 3 is a perspective view showing the printer in a state, where an installation cover of a container installed part is closed, according to the embodiment of the present disclosure.
Figure 4:
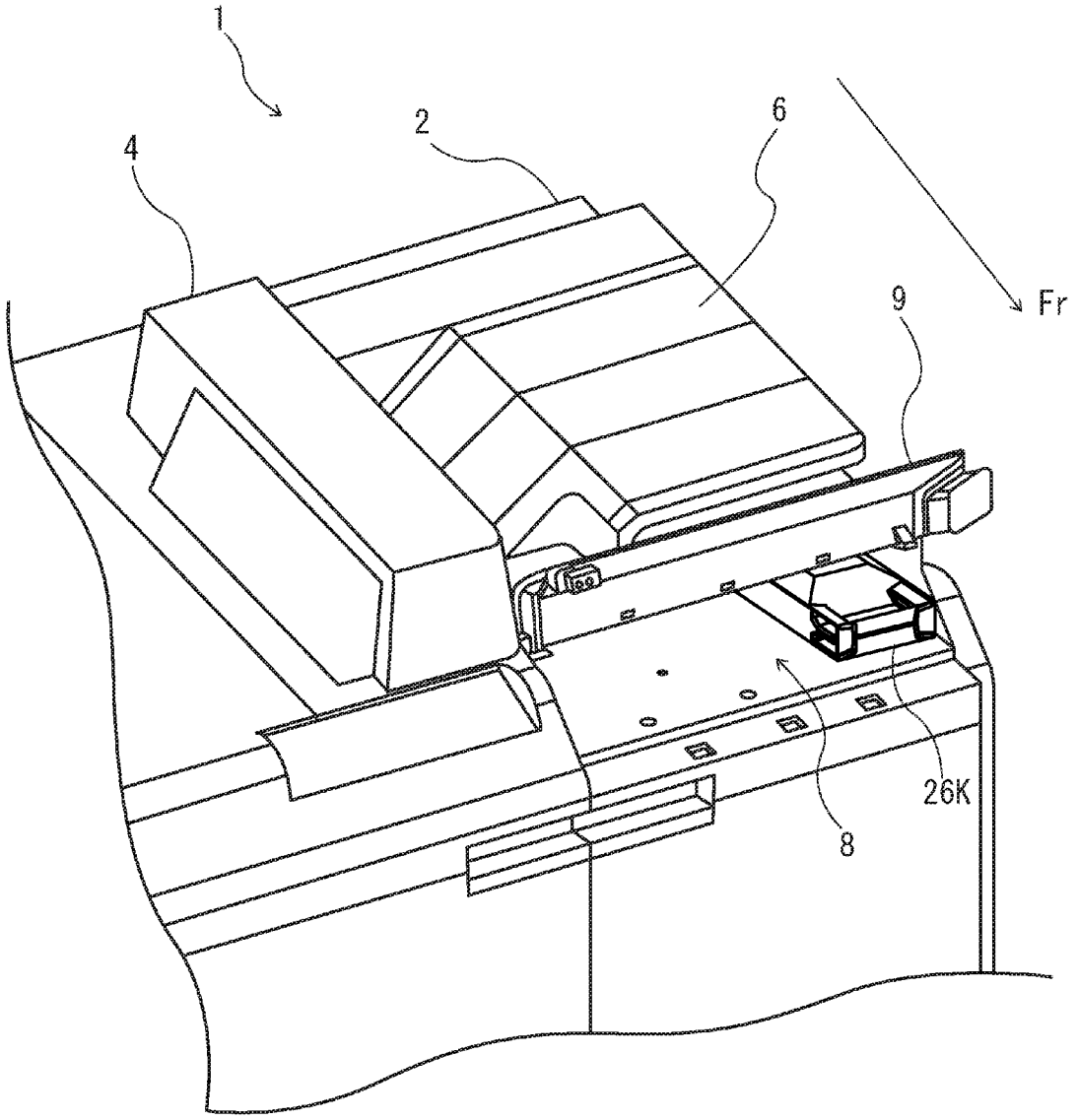
FIG. 4 is a perspective view showing the printer in a state, where the installation cover of the container installed part is opened, according to the embodiment of the present disclosure.

In a top face of the printer main body 2, a protrusion 4 is formed in the vicinity of the center. In a right face of the protrusion 4, an ejecting port 5 ejecting the sheet with a formed image is opened. In the top face of the printer main body 2, an ejected sheet tray 6 receiving the sheet with the formed image is arranged at the right side of the protrusion 4 and a touch panel-type operational panel 7 is attached at the front side of the protrusion 4. FIG. 3 and FIG. 4 illustrate a state, where the operational panel 7 is detached, for the sake of convenience of the description. Further, in a right upper part of the printer main body 2, a container installed part 8 is arranged. On a front face of the container installed part 8, an installation cover 9 is attached openably/closably (refer to FIG. 3 and FIG. 4).

As shown in FIG. 2, in a right side part of the printer main body 2, a conveying path 10 for the sheet P is arranged. At an upstream end of the conveying path 10, a sheet feeding roller 11 is positioned near the sheet feeding cartridge 3 and, at the right side of the sheet feeding roller 11, a pair of conveying rollers 12 are positioned. At a downstream end of the conveying path 10, a pair of registration rollers 13 are positioned.

In an intermediate part of the printer main body 2, an upward/downward movable conveying unit 14 is attached. The conveying unit 14 includes a conveyance frame 15, a driving roller 16, a following roller 17, a tension roller 18, an endless conveyance belt 19 and an air intake duct 20. The driving roller 16 is rotatably supported at a left upper corner of the conveyance frame 15. The following roller 17 is rotatably supported at a right upper corner of the conveyance frame 15. The tension roller 18 is rotatably supported at a middle lower part of the conveyance frame 15. The conveyance belt 19 is wound around the driving roller 16, the following roller 17 and the tension roller 18. The air intake duct 20 is located so as to be surrounded by the conveyance belt 19.

In an upper face of the conveyance belt 19, a roughly flat conveyance face 21 is formed. The conveyance belt 19 has a lot of air intake holes (not shown) and a top face of the air intake duct 20 also has a lot of air intake holes (not shown). The air intake duct 20 is connected with a suction device (not shown), such as a suction pomp. Accordingly, by activating the suction device, an air can be sucked via the air intake holes of the conveyance belt 19 and the air intake holes of the air intake duct 20 from a surface side of the conveyance face 21 in the conveyance belt 19 to the air intake duct 20.

In an intermediate lower part of the printer main body 2, a pair of left and right elevating devices 22 is attached below the conveying unit 14. Each elevating device 22 includes a rotation axis 23 and a cam 24 supported by the rotation axis 23. The rotation axis 23 is connected with a driving device (not shown), such as a driving motor. Accordingly, by activating the driving device, the cam 24 is rotated around the rotation axis 23, and then, a posture of the cam 24 is switched between an upright posture (refer to solid line in FIG. 2) and a laid-down posture (refer to two-dot chain line in FIG. 2). The cam 24 is switched to the upright posture to lift up the conveyance frame 15 and to move the conveying unit 14 upward or switched to the laid-down posture to release the lift of the conveyance frame 15 and to move the conveying unit 14 downward.

In the intermediate part of the printer main body 2, four recording heads 25 (25K, 25C, 25M, 25Y) are arranged in parallel above the conveying unit 14. The recording heads 25 correspond to black (K), cyan (C), magenta (M) and yellow (Y) from an upstream side (a right side in the embodiment) in order of a conveying direction of the sheet P. Hereinafter, except for the description to be specified by the colors, the reference characters "K", "C", "M" and "Y" with regard to the recording heads 25 are omitted. The recording heads 25 are provided with respective nozzles (not shown) facing to the conveyance face 21 of the conveyance belt 19.

In the container installed part 8 in the upper part of the printer main body 2, four ink containers 26 (26K, 26C, 26M, 26Y) are installed in parallel attachably/detachably in forward and backward directions. The ink containers 26 contains the inks of black (K), cyan (C), magenta (M) and yellow (Y) from an upstream side (a right side in the embodiment) in order of the conveying direction of the sheet P. Hereinafter, except for the description to be specified by the colors, the reference characters "K", "C", "M" and "Y" with regard to the ink containers 26 are omitted. In FIG. 4, the ink container 26K corresponding to the black (K) is installed to the container installed part 8. In the embodiment, the front side of the printer 1 is a near side (one end of the ink container 26) in an installing direction of the ink container 26 to the container installed part 8. The rear side of the printer 1 is a far side (other end of the ink container 26) in the installing direction of the ink container 26 to the container installed part 8.

Each ink container 26 is connected to each recording head 25 via each of sub containers (not shown) of respective colors. The ink contained in each ink container 26 is temporarily saved in each sub container, and then, supplied to each recording head 25. In the far side in the container installed part 8, hollow needles (not shown) connected to the ink supplying paths to the sub containers are provided for respective ink colors, respectively. Each needle is formed so as to connect to a spout 33 of an ink pack 30 in each ink container 26 as described later.

In a left upper part of the printer main body 2, a drying device 27 is arranged at the left upper side of the conveying unit 14 and an ejecting path 28 is arranged at the left side of the conveying unit 14. The ejecting path 28 extends upward to the protrusion 4 of the printer main body 2. At a downstream end of the ejecting path 28, a pair of ejecting rollers 29 are located in the vicinity of the ejecting port 5 inside the protrusion 4.

Next, the operation of forming an image by the printer 1 having such a configuration will be described.

In the printer 1, when image data is received from an external computer or the like, the sheet P stored in the sheet feeding cartridge 3 is picked up and fed to the conveying path 10 by the sheet feeding roller 11. The sheet P fed to the conveying path 10 is conveyed to a downstream side of the conveying path 10 by the pair of conveying rollers 12, and then, fed to the conveyance face 21 of the conveyance belt 19 by the pair of registration rollers 13. The sheet P fed to the conveyance face 21 of the conveyance belt 19 is absorbed to the conveyance face 21 by suction force of the suction device (not shown) connected with the air intake duct 20.

On the other hand, to each recording head 25, the ink is supplied from each ink container 26. Each recording head 25 ejects the ink to the absorbed sheet P on the conveyance face 21 on the basis of the information of the image data. Thereby, a color ink image is formed on the sheet P. The sheet P having the color ink image is advanced so that the ink on the surface is dried by the drying device 27, and then, passed through the ejecting path 28, and moreover, ejected on the ejected sheet tray 6 via the ejecting port 5 by the pair of ejecting rollers 29.

Figure 5:
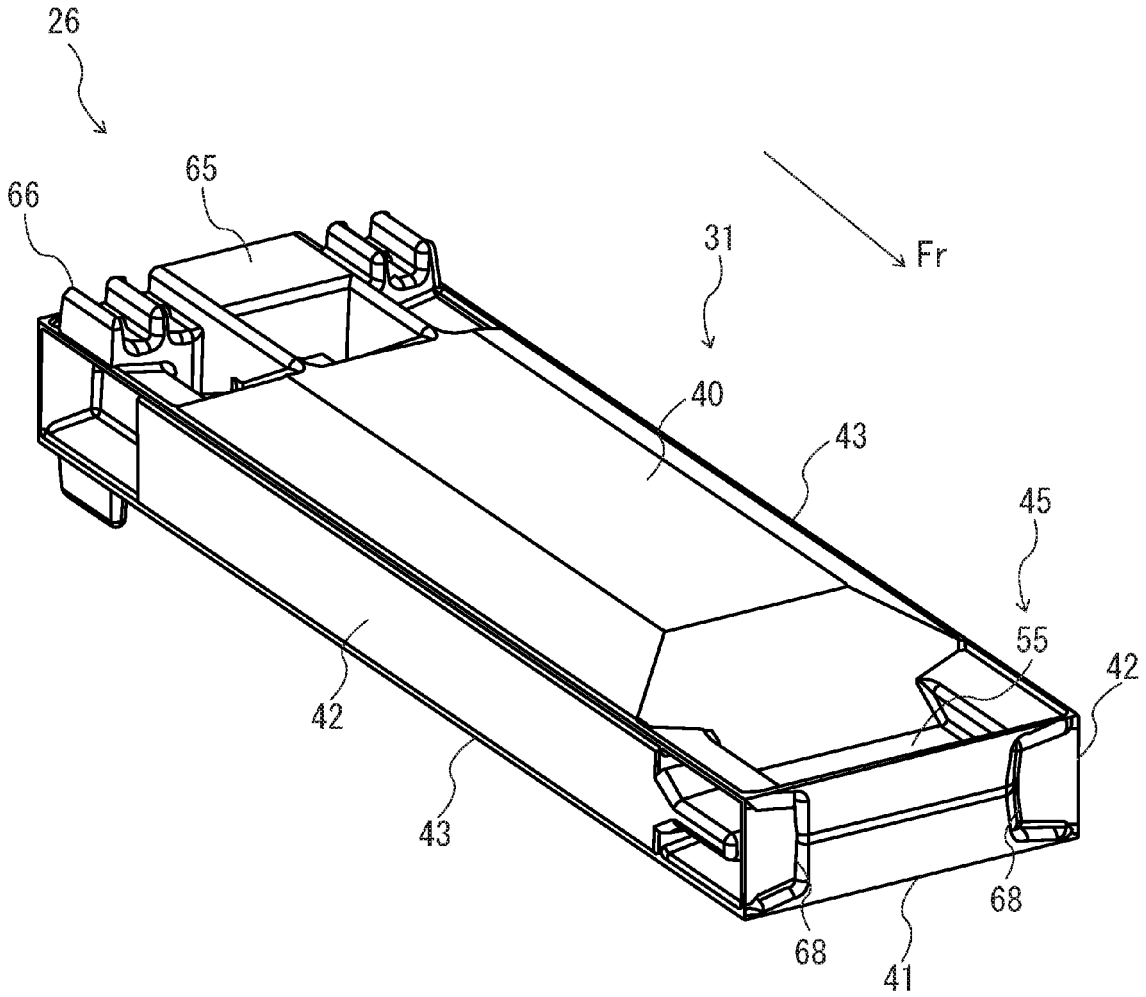
FIG. 5 is a front perspective view showing an ink container applied to the printer according to the embodiment of the present disclosure.
Figure 6:
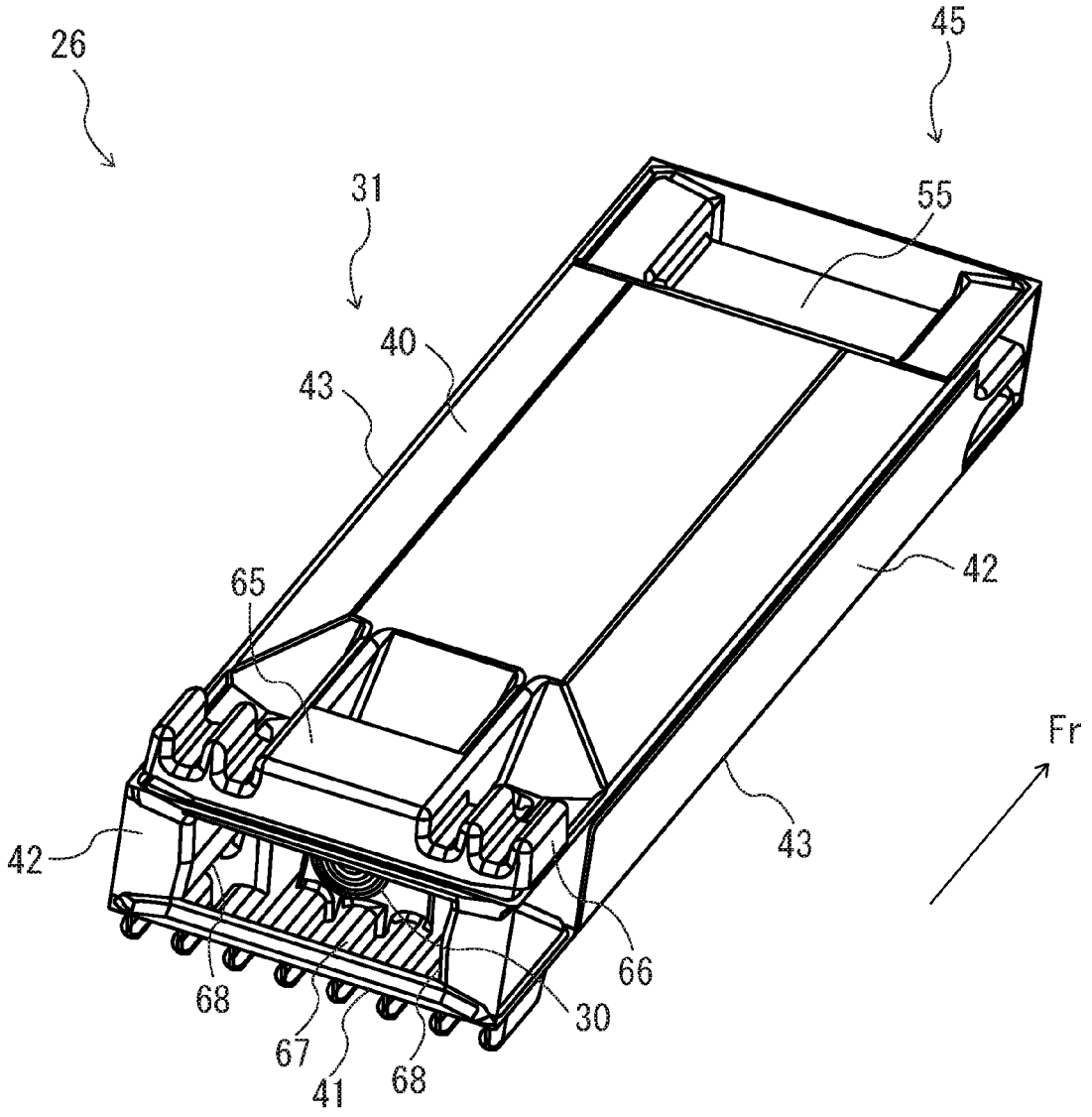
FIG. 6 is a rear perspective view showing the ink container applied to the printer according to the embodiment of the present disclosure.
Figure 7:
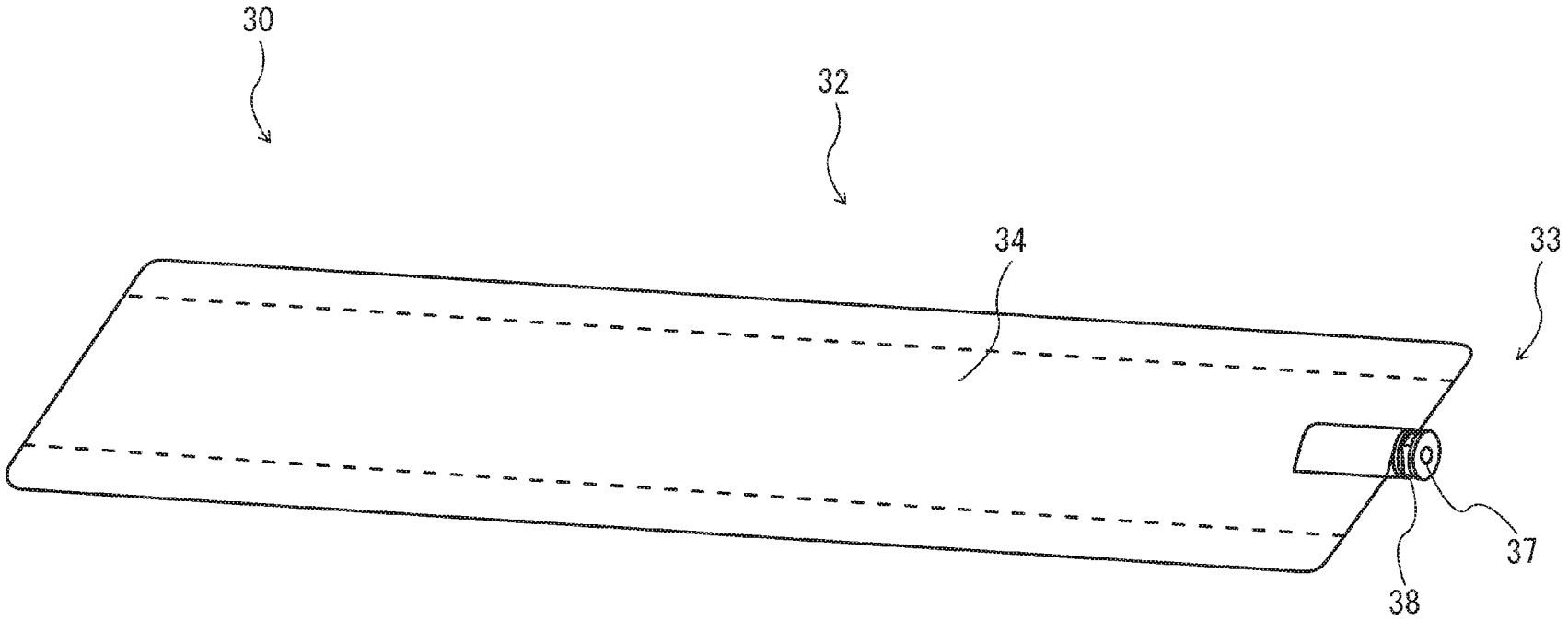
FIG. 7 is perspective view showing an ink pack in an ink emptied state applied to the printer according to the embodiment of the present disclosure.
Figure 8:
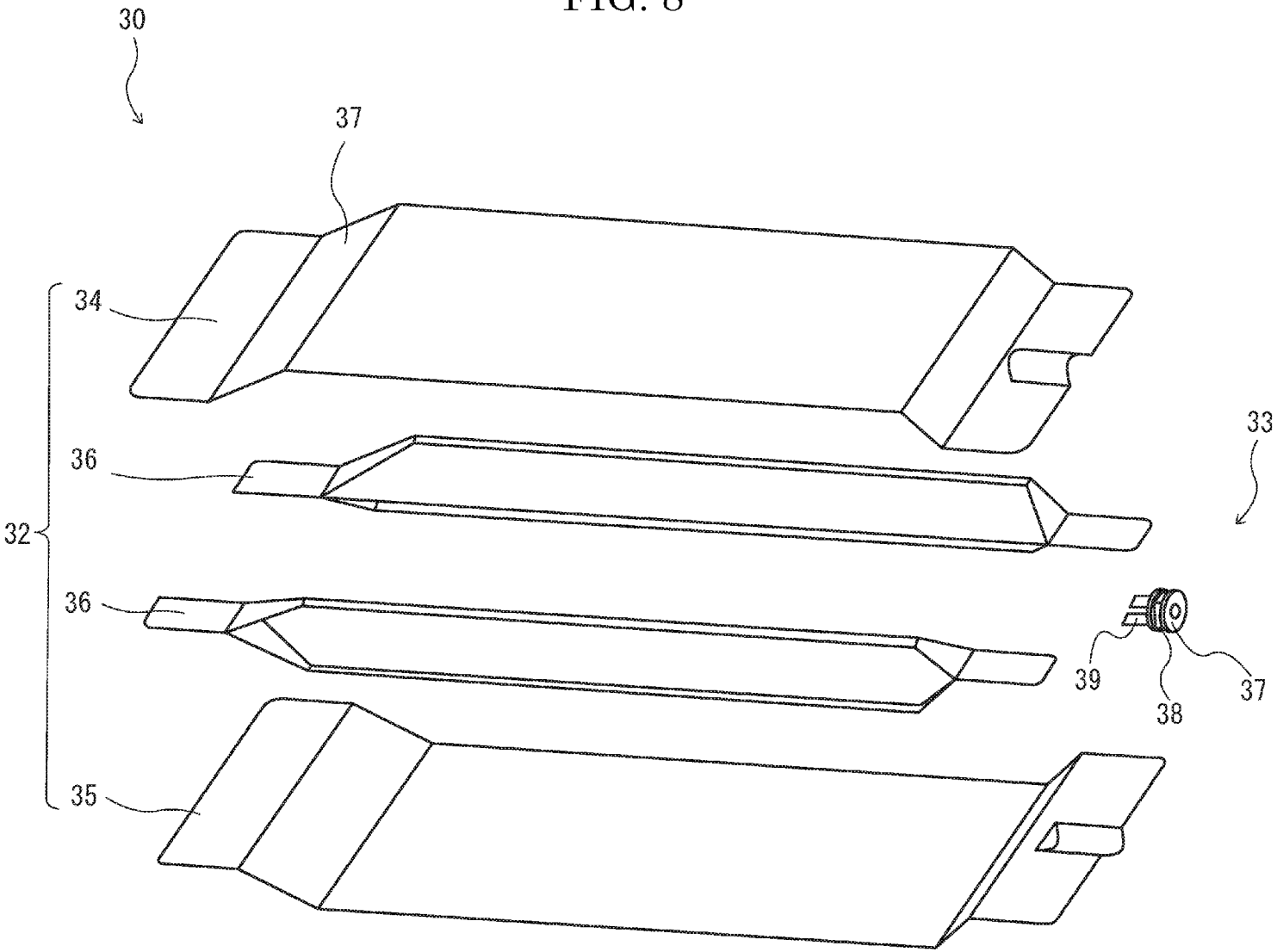
FIG. 8 is an exploded perspective view showing the ink pack applied to the printer according to the embodiment of the disclosure.
Figure 9:
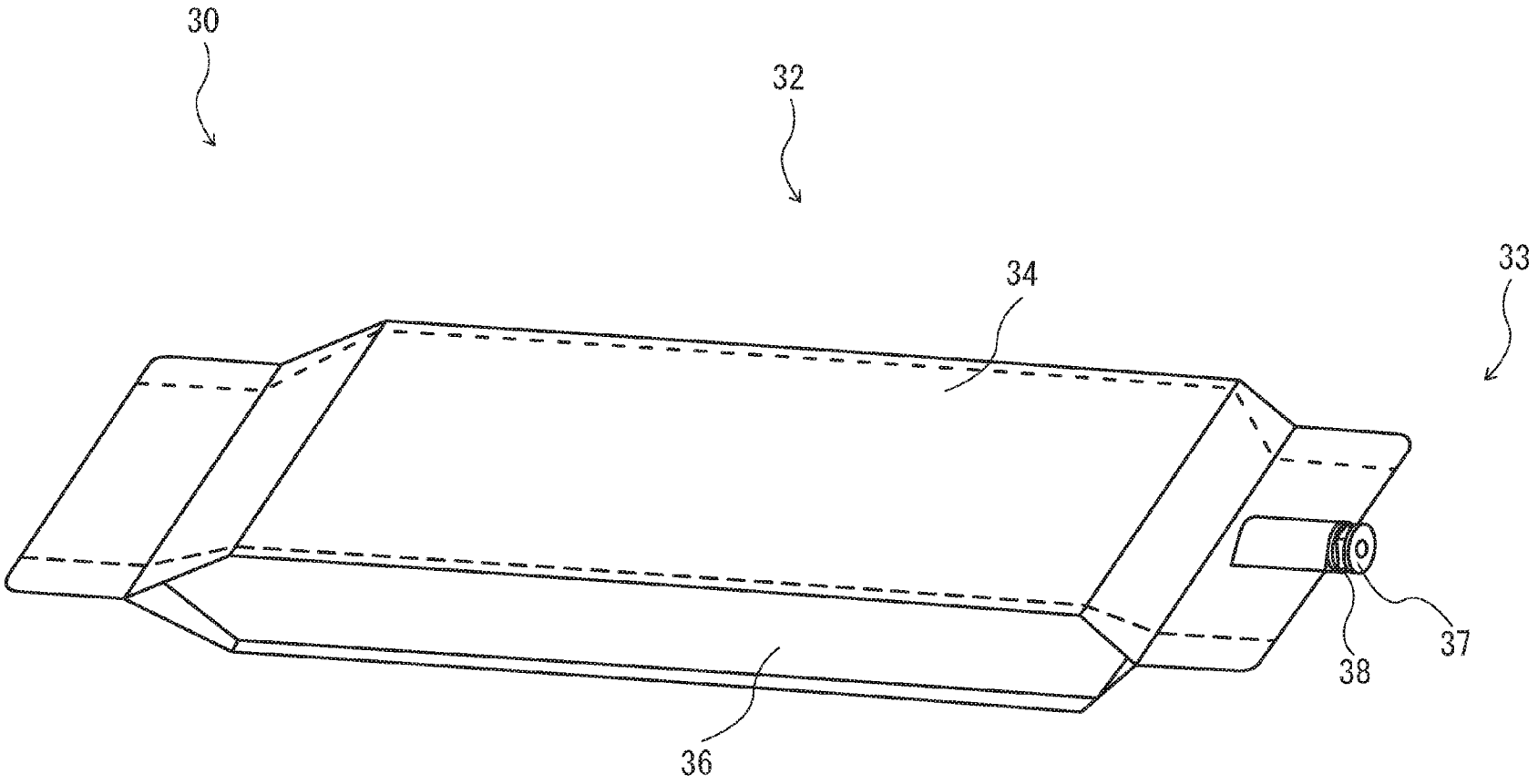
FIG. 9 is a perspective view showing the ink pack in an ink filled state applied to the printer according to the embodiment of the present disclosure.

Next, the ink containers 26 will be described. Since four ink containers 26 have a similar construction, one of the ink containers 26 will be described hereinafter. The ink container 26 includes, as shown in FIG. 5 and FIG. 6 and other figures, the ink pack 30 in which ink is to be charged and a container case 31 which houses the ink pack 30. First, the ink pack 30 will be described with reference to FIG. 7 to FIG. 9. The container case 31 will be described later.

The ink pack 30 includes a pack main body 32 elongated in forward and backward directions and formed in a bag-like shape of gusset type and a spout 33 partially embedded in a distal end of the pack main body 32. The ink pack 30 is configured so as to seal the ink in a vacuum state in the pack main body 32 and, when the spout 33 is communicated, the ink in the pack main body 32 can be discharged via the spout 33.

The pack main body 32 is made of a film member having flexibility (elasticity). This film member is made by laminating materials, such as plastics and aluminum, in at least two layers or more. As one example, in sequential order from the surface side, polyester (PET), aluminum (AL), nylon (PA), and low density polyethylene (LLDPE) are laminated. Polyester is employed as a surface layer of the pack main body 32, and the appearance and strength of the ink pack 30 can be thereby improved. An aluminum layer is formed in the pack main body 32, and it becomes thereby possible to improve the gas barrier property of the ink pack 30, and the preservation property of the ink can be enhanced. Namely, in the embodiment, aluminum is employed as the barrier member. A nylon layer is formed in the pack main body 32, and the mechanical strength and the impact resistance of the ink pack 30 can be thereby improved. Low density polyethylene is employed as a back face layer, that is, the innermost layer, and the welding strength exerted when the film member is formed in a bag-like shape by welding is thereby increased, and the sealing property can be improved. Incidentally, the innermost layer of the pack main body 32 may be made of polypropylene in place of polyethylene.

The pack main body 32 is configured, for example, so that a pair of side films 36 having gussets are provided between a planar upper film 34 and a planar lower film 35 on both sides. Between distal edges of the upper film 34 and the lower film 35, a spout 33 is attached at a center. Each side film 36 is folded back along a centerline in left and right directions, and respective facing interior faces of a distal edge and a proximal edge are welded and are formed to be expandable in upward and downward directions.

In the upper film 34 and the lower film 35, the respective lateral edges are welded with a pair of side films 36, the respective distal ends are further welded together with the spout 33, and the respective proximal ends are welded, and the liquid tightness of the pack main body 32 is thereby ensured. Incidentally, although the proximal ends of the upper film 34 and the lower film 35 are welded all over, at the distal ends of the upper film 34 and the lower film 35, a U-shaped region other than a part of the internal space of the pack main body 32 is welded, and at this time, a non-weld region which is not welded is obtained as a region for maintaining communication between the internal space of the pack main body 32 and the spout 33.

In the pack main body 32, if the inside is inflated as in a case in which ink is charged in the ink pack 30, the fold of the pair of side films 36 is expanded and each side film 36 is erected, and the upper film 34 and the lower film 35 are thereby spaced from each other. At this time, front parts and rear parts of the upper film 34 and the lower film 35 are inclined, and a length of the pack main body 32, that is, a length of the ink pack 30 is decreased. Also, in the pack main body 32, if the inside is contracted as in a case in which the ink is discharged from the ink pack 30, the pair of side films 36 is folded along the fold, whereby the upper film 34 and the lower film 35 are approached each other, and the length of the pack main body 32, that is, the length of the ink pack 30 is extended. Incidentally, the upper film 34 and the lower film 35 and the pair of side films 36 each have elasticity, and thus, these films are foldable irrespective of the fold, and however, the fold is provided in advance, and the pack main body 32 can be thereby folded to actively expand in the forward and backward directions with the decrease of the ink.

The spout 33 is formed in a roughly cylindrical shape, and has a supply port 37, a fixed part 38, and a joint port 39. The supply port 37 is formed to open at a distal end of the spout 33 so that a needle of a container installed part 8 is inserted. The fixed part 38 is formed in a hexagonal prism shape, for example, so as to be fixed to a spout fixing part 47 of the container case 31 described later. The joint port 39 is disposed in the non-weld region between the distal ends of the upper film 34 and the lower film 35, and is configured so that, when the distal ends of the upper film 34 and the lower film 35 are approached each other, communication of the spout 33 is not prevented. Also, inside of the spout 33, a valve body (not shown) is provided, and this valve body is configured so that, when the ink pack 30 is installed to the container installed part 8, the spout 33 is communicated, and when the ink pack 30 is detached from the container installed part 8, the spout 33 is closed.

Next, the container case 31 will be described with reference to FIG. 5 and FIG. 6 and FIG. 10 to FIG. 18. The container case 31 includes an upper plate 40 and a lower plate 41 which respectively cover the ink pack 30 from the upper side and the lower side and two side plates 42 which are respectively provided at side parts of the upper plate 40 and the lower plate 41. Incidentally, FIG. 13 and FIG. 14 each show a container case 31 with the upper plate 40 being removed therefrom. Also, the container case 31 includes a hinge 43 which couples the upper plate 40 and one side plate 42 to each other, and includes hinges 43 which couple the lower plate 41 and two side plates 42 to each other.

The upper plate 40, the lower plate 41, the side plate 42 and the hinge 43 constituting the container case are integrally molded from a plastic material (for example, plastic material having transparency) such as PET by vacuum molding, injection molding, or blow molding or the like, and has an shape in which assembling is possible. For example, the upper plate 40, the lower plate 41, the side plates 42 and the hinge 43 are prepared to be adsorbed in a die, in a state where one plastic sheet has been heated and softened by vacuum molding, and immediately after molding, post-processing such as cutting becomes possible.

Figure 10:
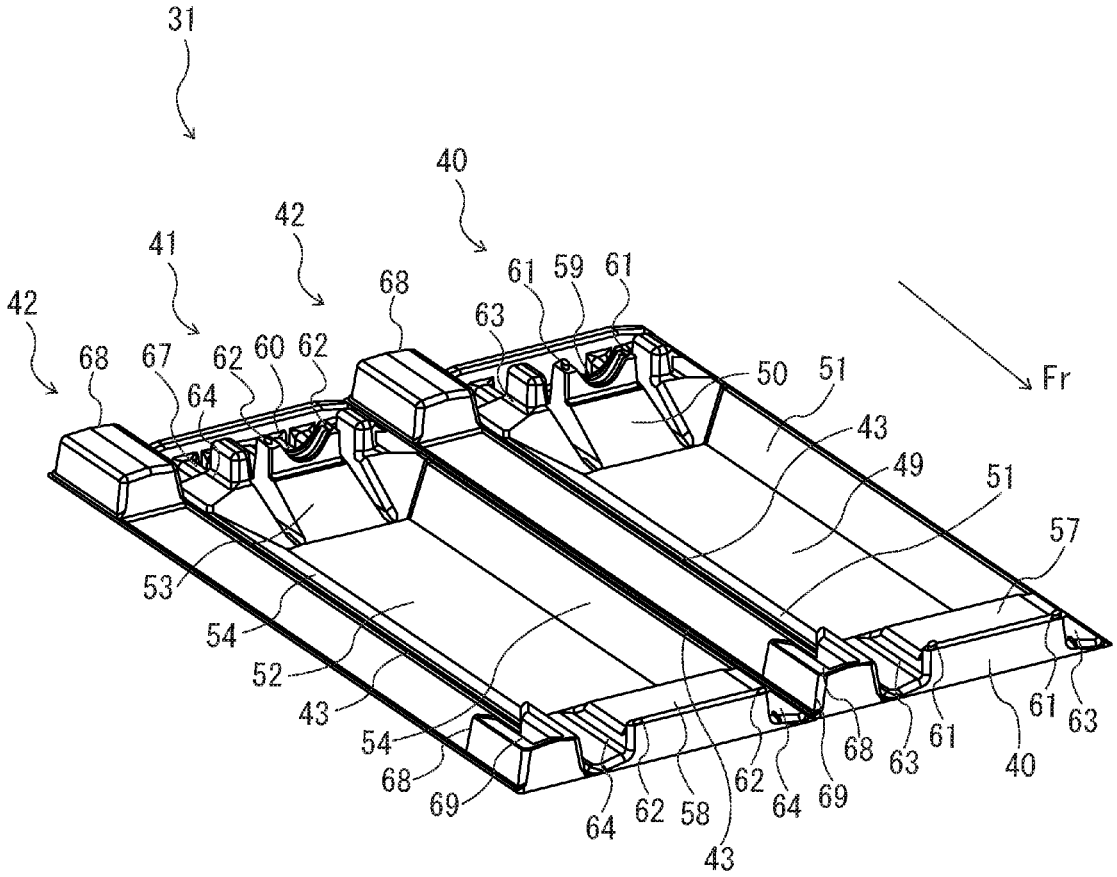
FIG. 10 is a front perspective view showing a container case in an unfolded state in the ink container applied to the printer according to the embodiment of the present disclosure.
Figure 11:
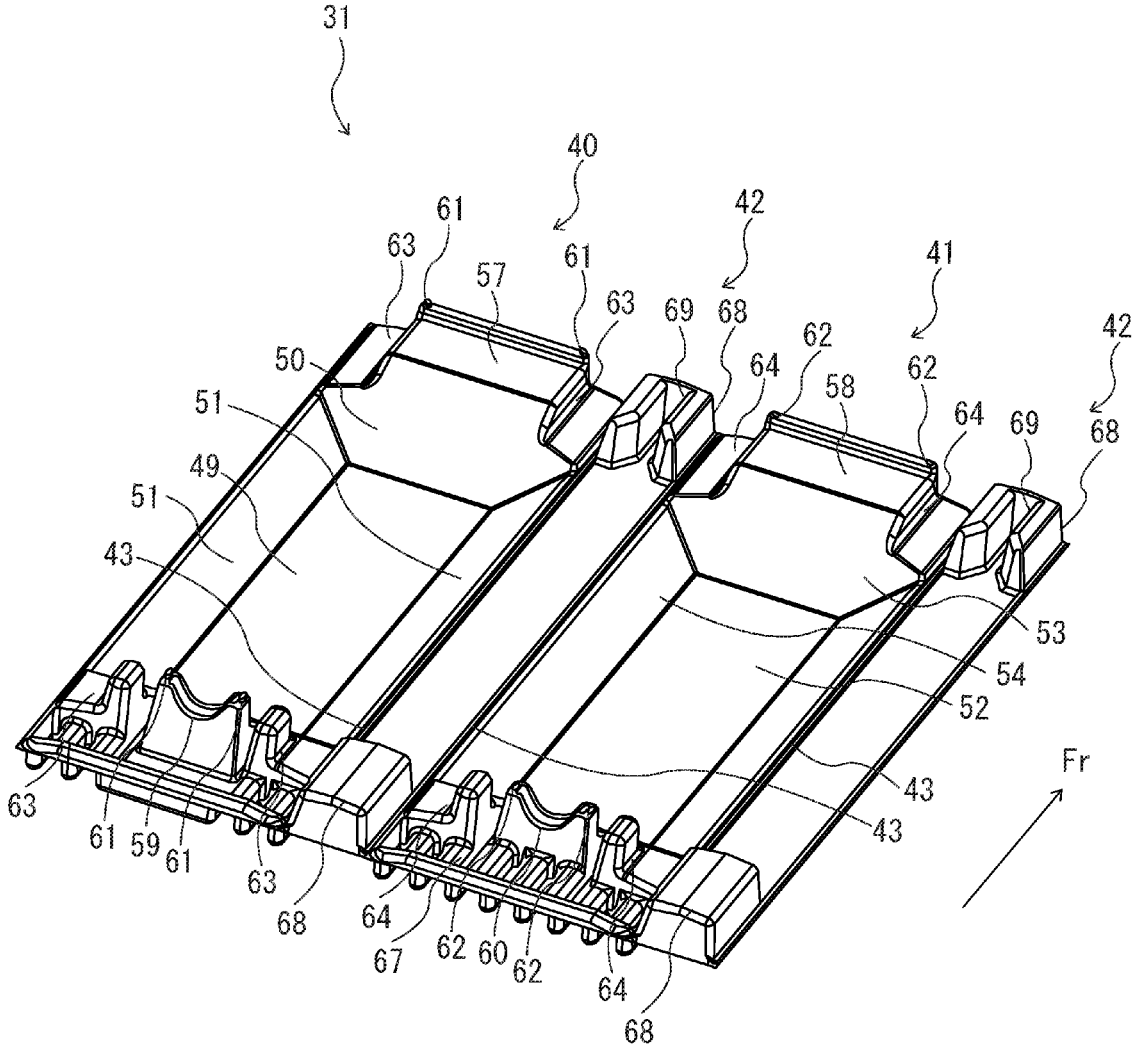
FIG. 11 is a rear perspective view showing the container case in an unfolded state in the ink container applied to the printer according to the embodiment of the present disclosure.
Figure 12:
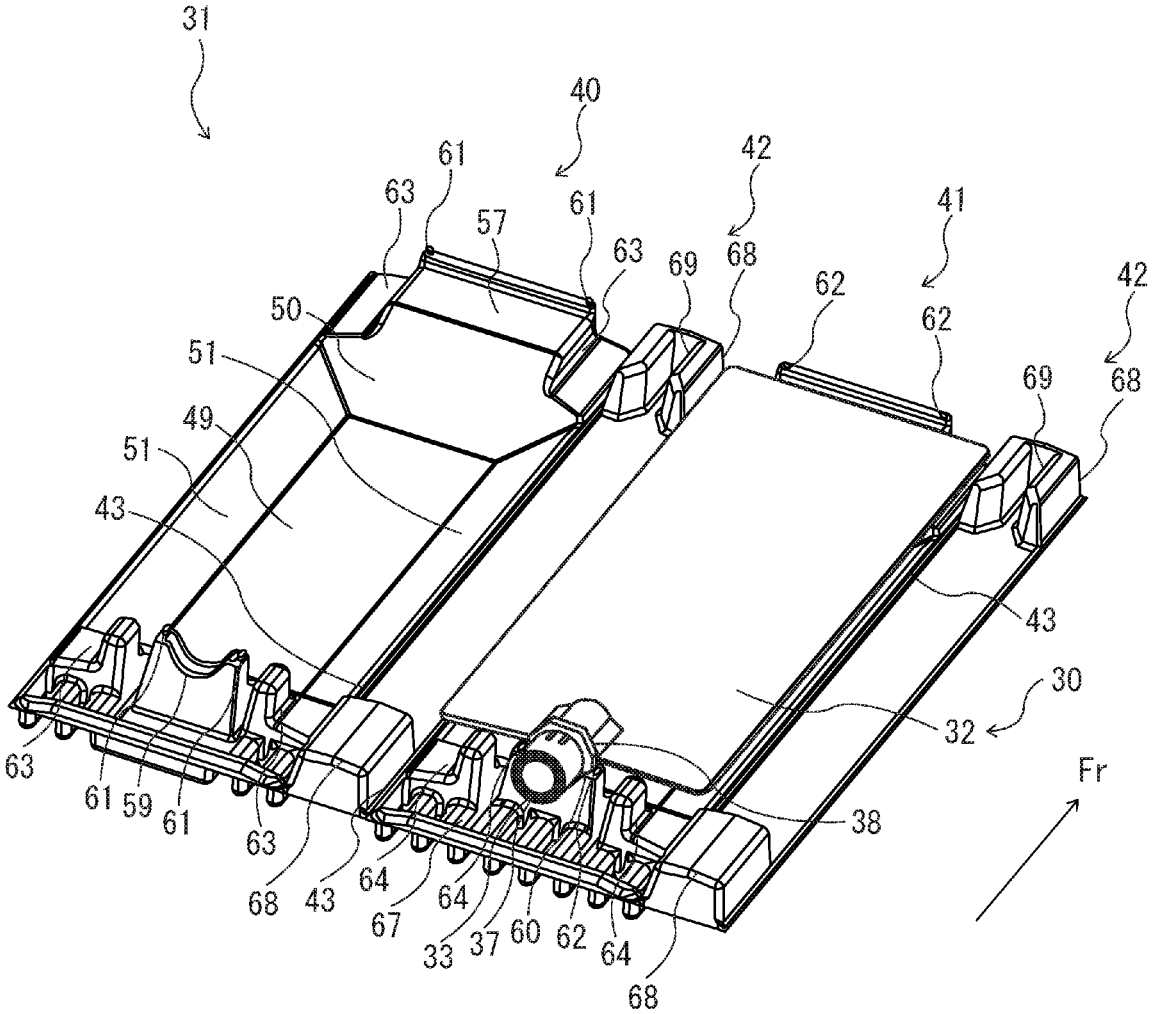
FIG. 12 is a rear perspective view showing the ink container in a state, where the container case is unfolded and the ink pack is placed on the container case, applied to the printer according to the embodiment of the present disclosure.
Figure 13:
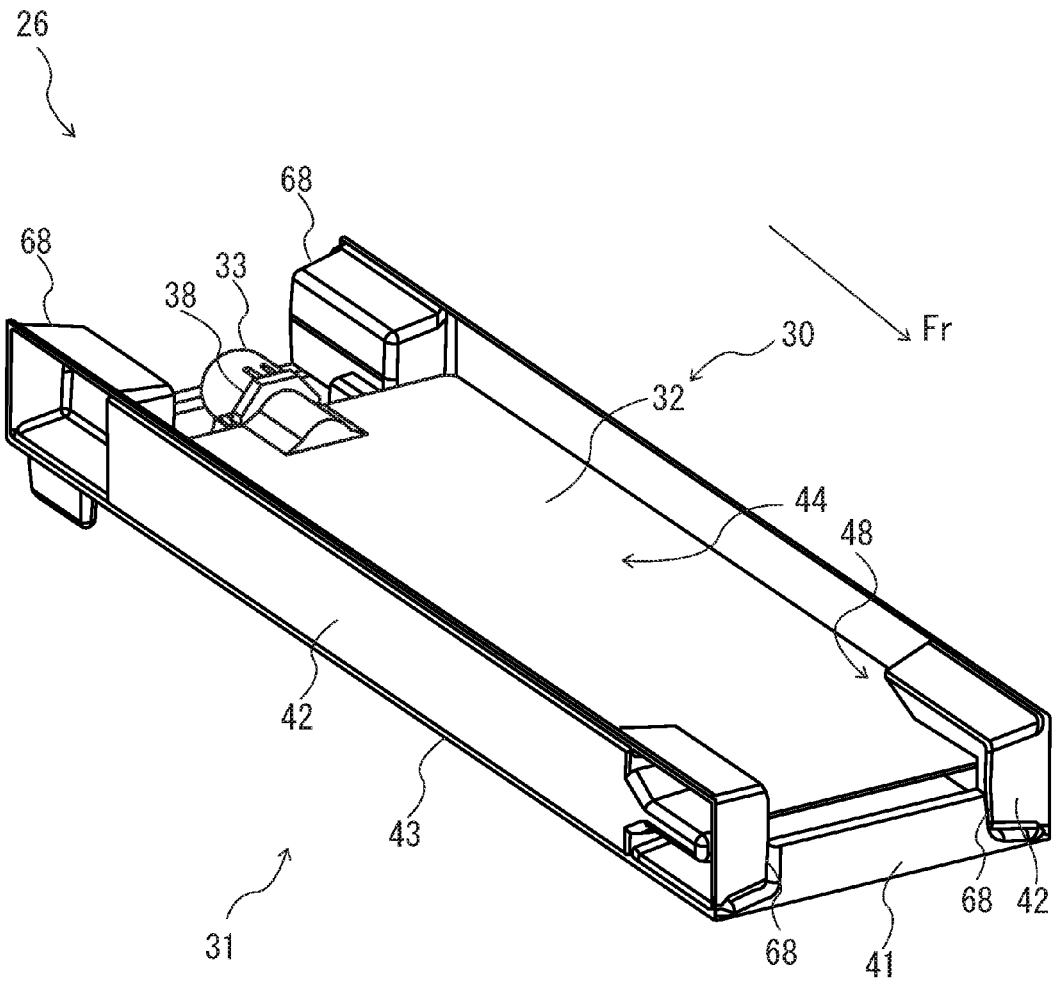
FIG. 13 is a front perspective view showing the ink container in a state, where an upper plate is detached, applied to the printer according to the embodiment of the present disclosure.
Figure 14:
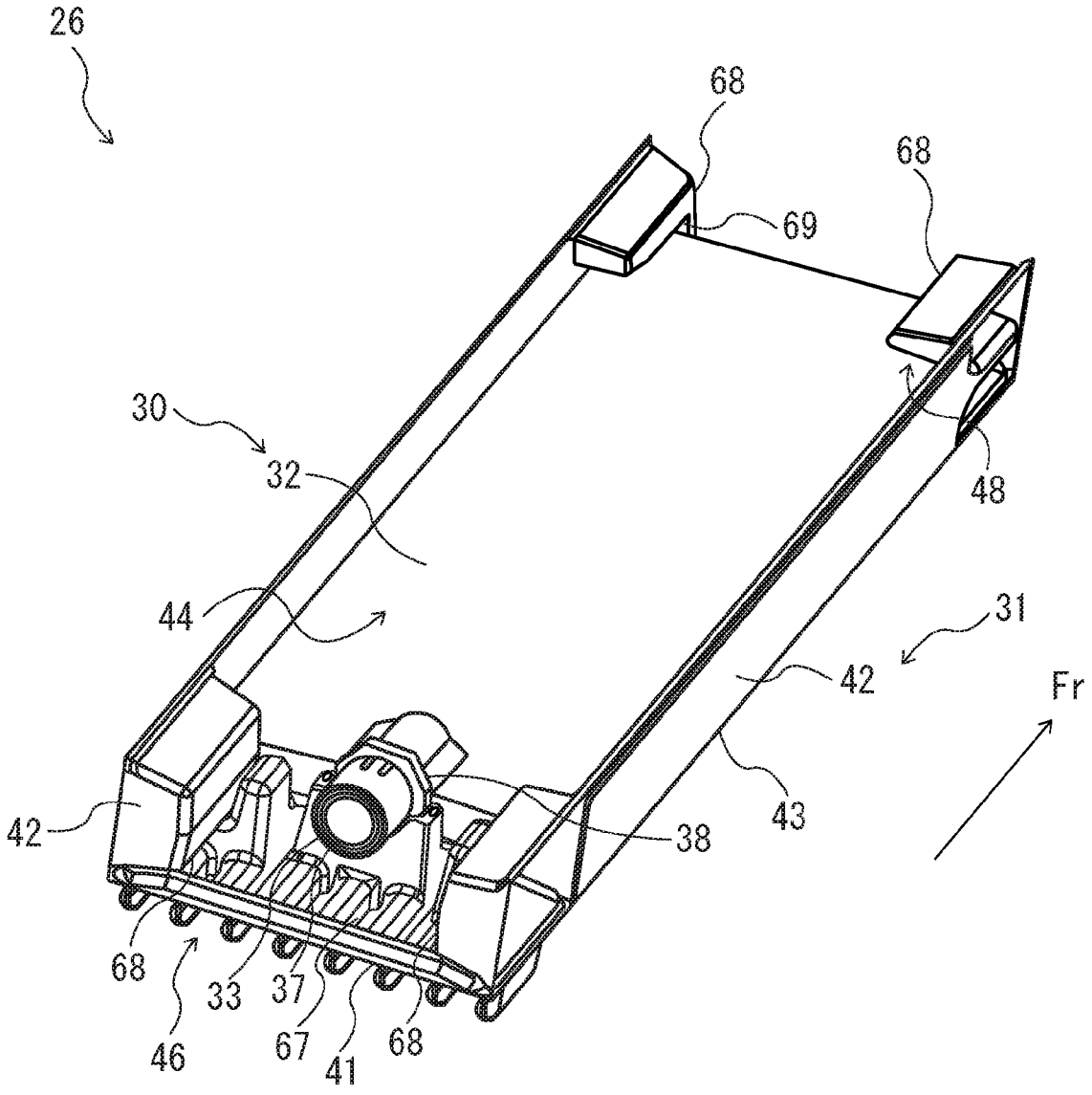
FIG. 14 is a rear perspective view showing the ink container in a state, where the upper plate is detached, applied to the printer according to the embodiment of the present disclosure.

The container case 31 immediately after molded is, as shown in FIG. 10 and FIG. 11, in an external shape of a roughly identical plane, and has an unfolded shape, and for example, the ink pack 30 is attachable to or detachable from the container case 31 in an unfolded state (refer to FIG. 12). The container case 31 after assembled has, as shown in FIG. 5 and FIG. 6, a shape of a roughly box-type case elongated in the forward and backward directions. Hereinafter, directions such as the upward and downward directions and the left and right directions used for explaining the container case 31 and components are determined with reference to the container case 31 in an assembled state in the shape of the case.

In the container case 31 after assembled, as shown in FIG. 13 to FIG. 16, a hollow housing 44 is provided at the internal center, and the ink pack 30 is housed in the housing 44. Incidentally, the container case 31 houses the ink pack 30 with the distal end (the spout 33 side) being oriented backward, that is, houses the ink pack 30 oriented backward. Further, in the container case 31 after assembled, there are provided a grip 45 configured at a front end (one end) (refer to FIG. 5 and FIG. 6), an aperture 46 configured at a rear end (the other end), a spout fixing part 47 configured at a front side (one end side) from the aperture 46 and an expansion housing 48 configured at a front side from the housing 44 and inside of the grip 45.

The upper plate 40 and the lower plate 41 are roughly plate-like members elongated in the forward and backward directions. The upper plate 40 is formed to have a first plane part 49 at a center of a bottom face, first inclined parts 50 continuing from the first plane part 49 and being inclined downward toward the front side and the rear side (the other end side) and second inclined parts continuing from the first plane part 49 and being inclined downward toward both sides in the left and right directions. The lower plate 41 is formed to have a first plane part 52 at a center of a top face, first inclined parts 53 continuing from the first plane part 52 and being inclined upward toward the front side and the rear side and second inclined parts 54 continuing from the first plane part 52 and being inclined upward toward both sides of the left and right directions. The first plane part 49, the first inclined parts 50 and the second inclined parts 51 of the upper plate 40, and the first plane part 52, the first inclined parts 53 and the second inclined parts 54 of the lower plate 41 constitute the housing 44 of the container case 31 after assembled.

Figure 15:
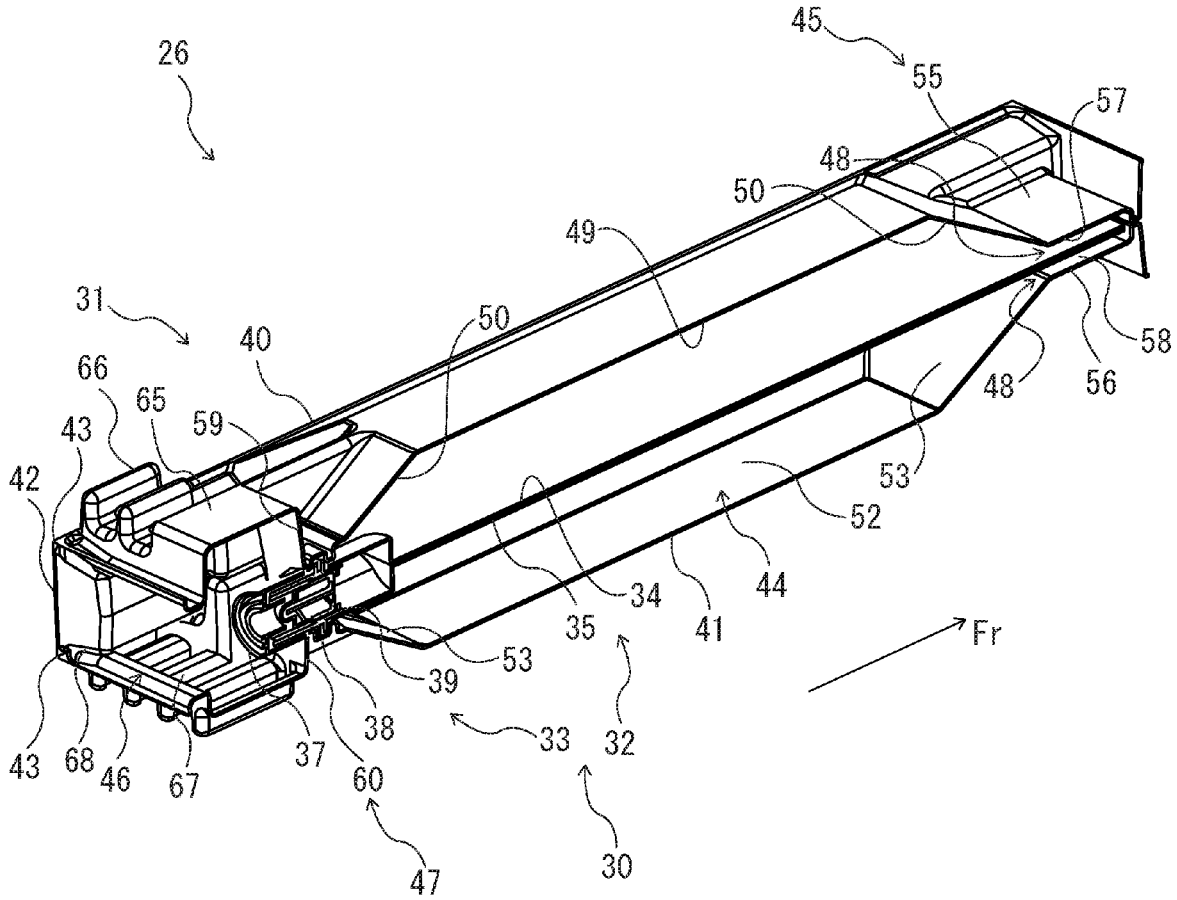
FIG. 15 is a sectional view showing the ink container along forward and backward directions applied to the printer according to the embodiment of the present disclosure.
Figure 16:
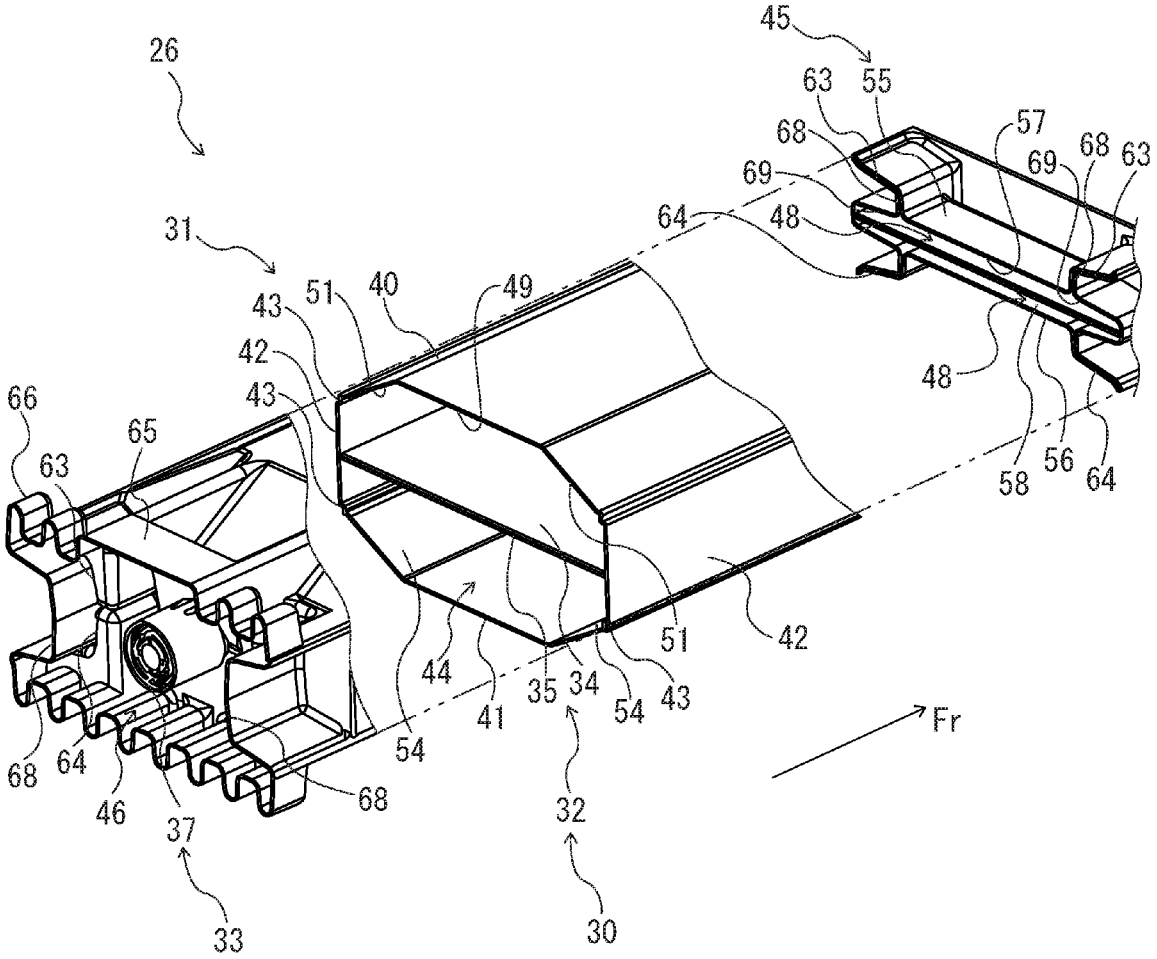
FIG. 16 is a sectional view showing the ink container along left and right directions applied to the printer according to the embodiment of the present disclosure.
Figure 17:
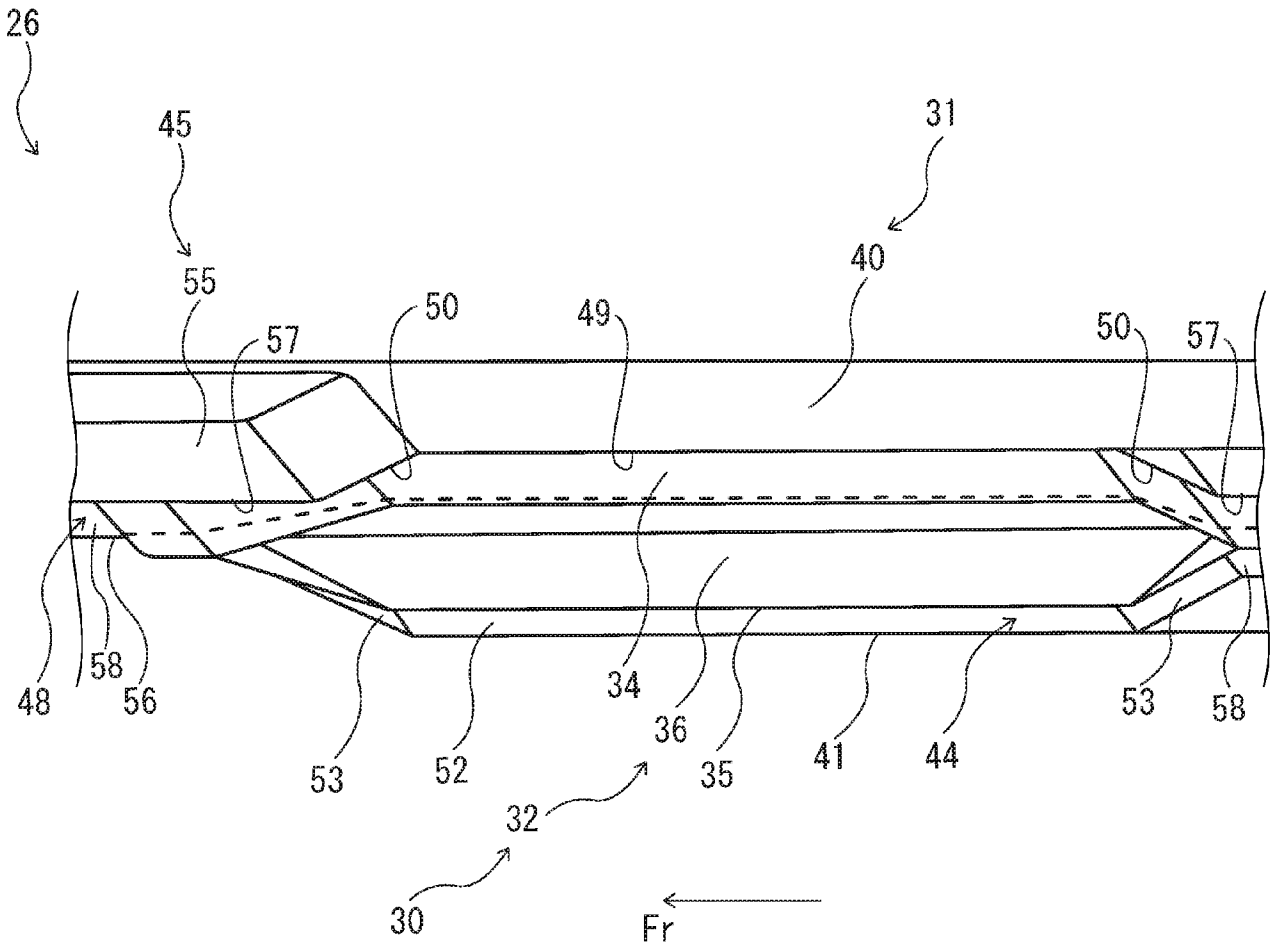
FIG. 17 is a sectional view showing the ink container in a state, where the ink in the ink pack is decreased, applied to the printer according to the embodiment of the present disclosure.
Figure 18:
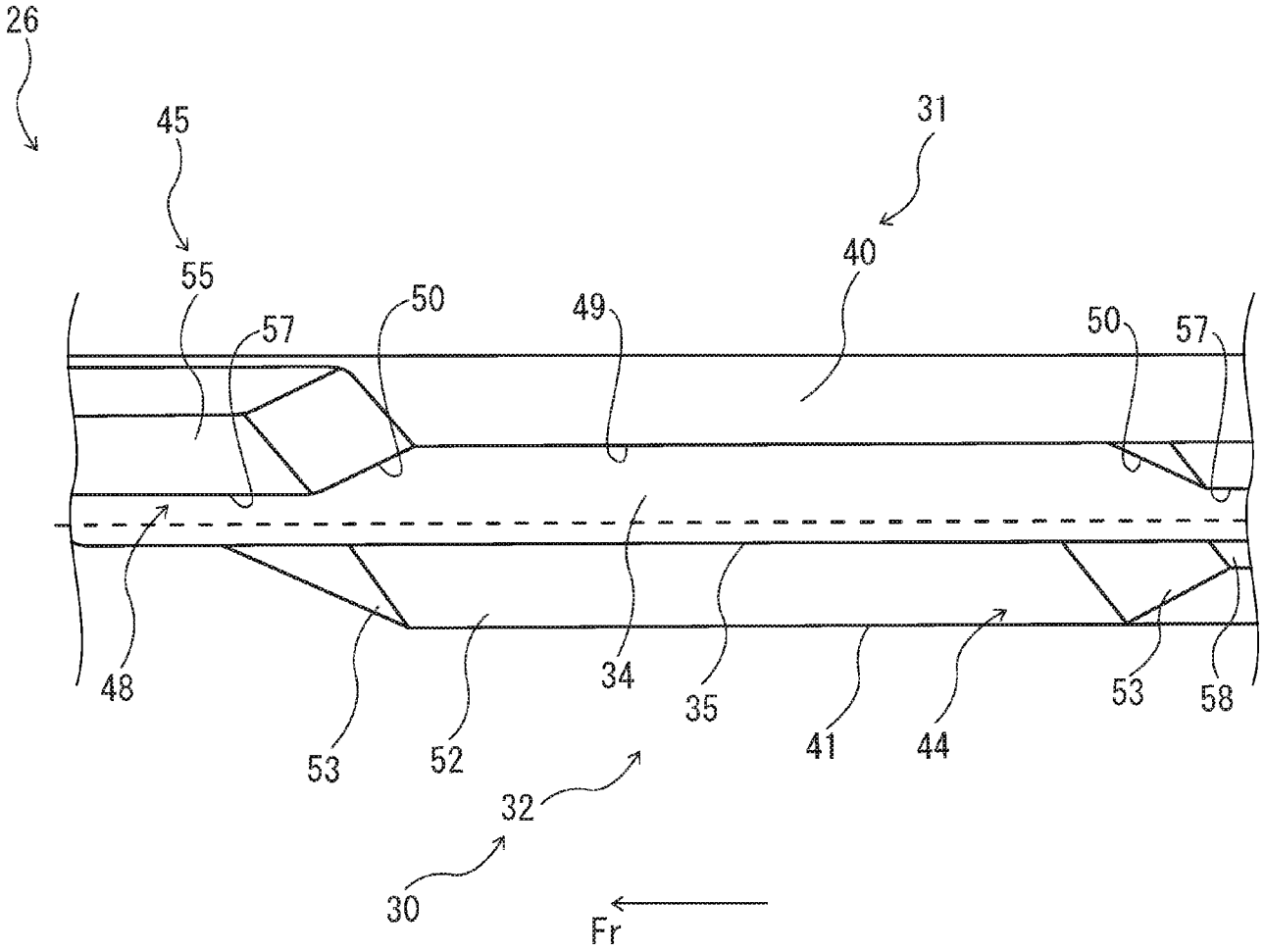
FIG. 18 is a sectional view showing the ink container along forward and backward directions in a state, where the ink pack is finished, applied to the printer according to the embodiment of the present disclosure.

As shown in FIG. 15 and FIG. 16, at a front end side of the upper plate 40, a gripping depression 55 is formed on a top face and, at a front end side of the lower plate 41, a gripping depression 56 is formed on a bottom face. The gripping depression 55 of the upper plate 40 and the gripping depression 56 of the lower plate 41 are provided as a pair of an upper portion and a lower portion, and constitute a grip 45 of the container case 31 after assembled.

Also, at the front end side of the upper plate 40, a second plane part 57 continuing from the first inclined part 50 is formed on the bottom face (back side of the gripping depression 55), and at the front end side of the lower plate 41, a second plane part 58 continuing from the first inclined part 53 is formed on the top face (back side of the gripping depression 56). The second plane part 57 of the upper plate 40 and the second plane part 58 of the lower plate 41 are provided as a pair of an upper portion and a lower portion, and are spaced to face each other in the container case 31 after assembled, and a space between the second plane part 57 and the second plane part 58 constitutes a part of the expansion housing 48 of the container case 31 after assembled.

At the rear end side of the upper plate 40, a U-shaped fixing depression 59 continuing from the first inclined part 50 is protruded on the lower face, and at the rear end side of the lower plate 41, a U-shaped fixing depression 60 continuing from the first inclined part 53 is protruded on the top face. The fixing depression 59 of the upper plate 40 and the fixing depression 60 of the lower plate 41 are provided as a pair of an upper portion and a lower portion, and constitute the spout fixing part 47 of the container case 31 after assembled. For example, when the ink pack 30 is housed in the container case 31, before assembling the container case 31, the ink pack 30 is placed on the lower plate 41, and the fixed part 38 of the spout 33 of the ink pack 30 is fitted into the fixing depression 60 of the lower plate 41 (refer to FIG. 12). After that, the ink pack 30 on the lower plate 41 is covered with the upper plate 40 from the upper side, and the fixed part 38 of the spout 33 of the ink pack 30 is fitted into the fixing depression 59 of the upper plate 40 from the upper side. In this manner, the fixed part 38 of the spout 33 of the ink pack 30 is fixed by the spout fixing part 47 made of the fixing depression 59 of the upper plate 40 and the fixing depression 60 of the lower plate 41, and the ink pack 30 is positioned in the container case 31.

In the upper plate 40, engaging protrusions 61 (engaging portions), such as snap-fit, are respectively formed at ends at a front side of the second plane part 57 and at ends of the fixing depression 59. In the lower plate 41, engaging depressions 62 (engaging portions), such as snap-fit, are respectively formed at ends at a front side of the second plane part 58 and at ends of the fixing depression 60. Each engaging protrusion 61 of the upper plate 40 and each engaging depression 62 of the lower plate 41 are provided as a pair of an upper portion and a lower portion, and engage with one another to connect the upper plate 40 and the lower plate 41 to each other, when the container case 31 is assembled.

In the upper plate 40, engaging depressions 63 are respectively formed on both sides of the left and right directions of the second plane part 57 and at a rear side from the fixing depression 59 and on both sides of the left and right directions. In the lower plate 41, engaging depressions 64 are respectively formed on both sides of the left and right directions of the second plane part 58 and at a rear side from the fixing depression 60 and on both sides in the left and right directions. Each engaging depression 63 of the upper plate 40 and each engaging depression 64 of the lower plate 41 are provided as a pair at an upper portion and a lower portion, and engage with one another while each of engaging protrusions of the side plate 42 described later is sandwiched therebetween, when the container case 31 is assembled. A rear end of the upper plate 40 and a rear end of the lower plate 41 are respectively disposed while the engaging protrusion 68 of the side plate 42 is sandwiched therebetween, and then, the aperture 46 is configured at a rear end of the container case 31 after assembled, and a predetermined space is provided at a backward side of the fixing depression 59 and the fixing depression 60 (spout fixing part 47).

Also, as shown in FIG. 15 and FIG. 16, at the rear end side of the upper plate 40, an RFID attaching part 65 and an ink color identifying part 66 are formed on the top face. The RFID attaching part 65 is formed so as to enable attachment of RFID storing information related to the ink container 26, such as color of the ink charged in the ink pack 30 of the ink container 26, and is formed in a planar shape, for example. The ink color identifying part 66 is formed to have a different shape depending on the color of the ink so as to enable to identify the color of the ink charged in the ink pack 30 of the ink container 26 by a user and a side of the container installed part 8. Since such an ink color identifying part 66 is provided, incorrect attachment of the ink container 26 to the container installed part 8 is prevented. In addition, since the ink color identifying part 66 is formed on the upper plate 40 integrally molded in the container case 31, this part can be provided at a low cost.

At the rear end side of the lower plate 41, an ink reception 67 is formed on the top face at the rear side of the fixing depression 60 (spout fixing part 47). The ink reception 67 receives the ink leaking from the spout 33 of the ink pack 30 when the ink container 26 is attached to or detached from the container installed part 8, and is formed in a sectional wavy shape having a plurality of gaps, for example.

Each side plate 42 is a roughly plate-shaped member elongated in the forward and backward directions. In each side plate 42, the engaging protrusions 68 protruding to the inside in the left and right directions are provided at the front end side and the rear end side, respectively. In each engaging protrusion 68 at the front end side, an expansion housing depression 69 is formed over the inside face in the left and right directions and the front face, and the expansion housing depression 69 has a ceiling face and a bottom face at respectively identical heights to the second plane part 57 of the upper plate 40 and the second plane part 58 of the lower plate 41, and constitutes a part of the expansion housing 48 of the container case 31 after assembled.

The hinge 43 is formed to be easily bendable in the inward direction, and is preferably formed to be hardly bendable in the outward direction.

Incidentally, although the container case 31 as mentioned above was described as to the construction in which two side parts 42 are provided, the container case 31 may be a construction in which either one side part 42 is provided, that is, at least one side part 42 is provided. Such a container case 31 may include the hinges 43 which couple the upper plate 40 and the lower plate 41 with one side part 42, that is, includes at least two hinges 43. In this case also, the upper plate 40, the lower plate 41, one side part 42 and two hinges 43 constituting the container case 31 are integrally molded, and has a shape in which assembling is possible.

In the embodiment, as described above, the ink container 26 of the printer 1 includes the ink pack 30 to be filled with the ink and the container case 31 housing the ink pack 30. The container case 31 includes the upper plate 40 and the lower plate 41 respectively covering the ink pack 30 from the upper side and the lower side, at least one side plate 42 provided between the side parts of the upper plate 40 and the lower plate 41 and at least two hinges 43 coupling the upper plate 40 and the lower plate 41 with the side plate 42 to each other. The upper plate 40, the lower plate 41, the side plate 42 and the hinge 43 are integrally molded. The upper plate 40, the lower plate 41 and the side plate 42 are bent by the hinge 43 so as to be thereby assembled as the container case 31 including the housing 44 configured to house the ink pack 30 at the center. the front ends (the one ends) of the upper plate 40 and the lower plate 41 constitute the grip 45, and the rear ends (the other ends) of the upper plate 40 and the lower plate 41 constitutes the aperture 46.

In this manner, since the container case 31 is integrally composed of a same material, it is possible to reduce the number of parts and the number of manufacturing steps and to reduce manufacturing costs. Since the container case 31 configures the grip 45 by assembling the upper plate 40 and the lower plate 41 integrally molded, it is possible to actualize the grip 45 with a simple construction and to facilitate installation of the ink container 26 to the printer 1. In the container case 31, since the side plate 42 between the upper plate 40 and the lower plate 41 and the hinge 43 between the upper plate 40 or the lower plate 41 and the side plate 42 are formed by integral molding, it is possible to construct the aperture 46 for connecting the printer 1 and the ink container 26 to each other without processing molded parts. Further, since the grip 45 and the aperture 46 are respectively provided at both ends of the forward and backward directions of the container case 31, the ink pack 30 is disposed to be spaced from both sides of the forward and backward directions of the container case 31, and thereby, the container case 31 is capable of having a function as a buffering member to appropriately protect the ink pack 30. Therefore, since the container case 31 housing the ink pack 30 is employed as an individual package case of the ink pack 30, it is possible to transport the container case 31 while being packed, as it is or with being put into an individual package bag, into a case, such as box made of corrugated board, containing a plurality of the ink containers 26. Therefore, since a packing member or a buffering member for the ink pack 30 is not required, it is possible to reduce transportation costs. Moreover, when the container case 31 per se is transported, since a special packing member or a special buffering member for the container case 31 is not required, it is possible to reduce transportation costs. Thus, according to the present disclosure, it is possible to provide the ink container 26 capable of reducing manufacturing costs and transportation costs, facilitating installation to the image forming apparatus, and improving reusability and recycling property and to provide the inkjet image forming apparatus, such as the printer 1, including this ink container 26.

Also, in the embodiment, the container case 31 includes the spout fixing part 47 fixing the spout 33 of the ink pack 30 at the rear end side (a side of the other end) in an assembled state, and the lower plate 41 includes the ink reception 67 at the rear end side from the spout fixing part 47. In this manner, at the time of attachment or detachment of the ink container 26, it is possible to receive the ink leaking from the spout 33 of the ink pack 30 and to prevent pollution of the printer 1 or the inside of the container installed part 8 with ink. Further, since the ink reception 67 is provided at a rear end of the container case 31, the ink pack 30 is disposed to be spaced from the rear end of the container case 31, and thereby, the container case 31 is capable of having a function as a buffering member to more appropriately protect the ink pack 30.

In addition, in the embodiment, the container case 31 includes the spout fixing part 47 fixing the spout 33 of the ink pack 30 at the rear end side in the assembled state, and the upper plate 40 includes the RFID attaching part 65 at the rear end side from the spout fixing part 47. In this manner, in a state where the pack main body 32 of the ink pack 30 and the RFID attaching part 65 have been spaced from each other, the ink pack 30 is attached to the container case 31. According to this, an RFID tag to be attached to the RFID attaching part 65 is capable of carrying out radio communication with a side of the printer 1 without being inhibited by an aluminum layer employed as a barrier member of the pack main body 32 or the ink having an electric conductivity. Further, since the RFID attaching part 65 is provided at the rear end of the container case 31, the ink pack 30 is disposed to be spaced from the rear end of the container case 31, and thereby, the container case 31 is capable of having a function as a buffering member to more appropriately protect the ink pack 30.

Furthermore, in the embodiment, the upper plate 40 and the lower plate 41 are configured, in a state in which the container case 31 has been assembled, so that the respective front end sides (one end sides) constituting the grip 45 are spaced to face each other and constitute the expansion housing 48 configured to house expansion of the ink pack 30 according to the degrease of the ink. In this manner, in a case where the ink decreases in quantity, and then, the ink pack 30 is contracted and its length is extended, the expansion housing 48 is capable of housing the expansion of the ink pack 30. Therefore, since the contraction of the ink pack 30 is not inhibited, such an expansion of the ink pack 30 that still remains without the ink being discharged is eliminated and it is possible to use the ink pack 30 until the ink has been fully used up. Further, since the expansion housing 48 is provided at the front end of the container case 31, the ink pack 30 is disposed to be spaced from the front end of the container case 31, and thereby, the container case 31 is capable of having a function as a buffering member to more appropriately protect the ink pack 30.

Still furthermore, in the embodiment, the upper plate 40 is formed so that the bottom face constituting the housing 44 has the first plane part 49 and the first inclined parts 50 continuing from the first plane part 49 and being inclined downward toward the front end side and the rear end side. The lower plate 41 is formed so that the top face constituting the housing 44 has the first plane part 52 and the first inclined parts 53 continuing from the first plane part 52 and being inclined upward toward the front end side and the rear end side. In this manner, as shown in FIG. 15, the front end side and the rear end side of the housing 44 are formed in a wedge shape, and both ends of the forward and backward directions of the ink pack 30 are configured in easily buckled shapes. Accordingly, when the ink pack 30 is about to deform with the decrease of the ink, the top face and the bottom face of the ink pack 30 are respectively guided toward the center of the upward and downward directions by the first inclined parts 50 of the upper plate 40 and the first inclined parts 53 of the lower plate 41. That is, it is possible to accelerate the contraction in the upward and downward directions of the ink pack 30, and then, it is possible to use the ink pack 30 until the ink has been fully used up (refer to FIG. 17 and FIG. 18). Further, since the first inclined parts 50 are provided in the upper plate 40 of the container case 31 and the first inclined parts 53 are provided in the lower plate 41, it is possible to enhance the rigidity of the container case 31. Accordingly, it is possible to enhance the strength at the time of attaching/detaching operation and the buffering property at the time of transportation of the ink container 26.

Yet furthermore, the upper plate 40 is formed so that the bottom face constituting the housing 44 has the first plane part 49 and the second inclined parts 51 continuing from the first plane part 49 and being inclined downward toward both sides. The lower plate 41 is formed so that the top face constituting the housing 44 has the first plane part 52 and the second inclined parts 54 continuing from the first plane part 52 and being inclined upward toward each side. In this manner, as shown in FIG. 16, since the housing 44 is formed to have a drum-shaped or octagonal-shaped cross section, both ends of the ink pack 30 are configured in easily buckled shapes. Accordingly, when the ink pack 30 is about to deform with the decrease of the ink, the top face and the bottom face of the ink pack 30 are respectively guided toward the center in the upward and downward directions by the second inclined parts 51 of the upper plate 40 and the second inclined parts 54 of the lower plate 41. That is, it is possible to accelerate the contraction in the vertical direction of the ink pack 30 and it is possible to use the ink pack 30 until the ink has been fully used up. Further, since the second inclined parts 51 are provided in the upper plate 40 of the container case 31 and the second inclined parts 54 are provided in the lower plate 41, it is possible to enhance the rigidity of the container case 31. Accordingly, it is possible to enhance the strength at the time of attaching/detaching operation and the buffering property at the time of transportation of the ink container 26.

Moreover, in the embodiment, the upper plate 40 and the lower plate 41 respectively include the engaging protrusion 61 (engaging portion) and the engaging depression 62 (engaging portion) configured to engage with each other. The engaging protrusion 61 of the upper plate 40 and the engaging depression 62 of the lower plate 41 are constructed with snap-fit. In this manner, it is possible to reliably carry out positioning between the upper plate 40 and the lower plate 41 and to maintain a state in which the container case 31 has been assembled. Further, it is possible to easily carry out assembling or disassembling of the container case 31, and then, to improve the assembling workability and to easily carry out replacement of the ink pack 30. Thus, it is possible to easily reuse the container case 31 and to easily recycle the ink container 26.

Figure 19:
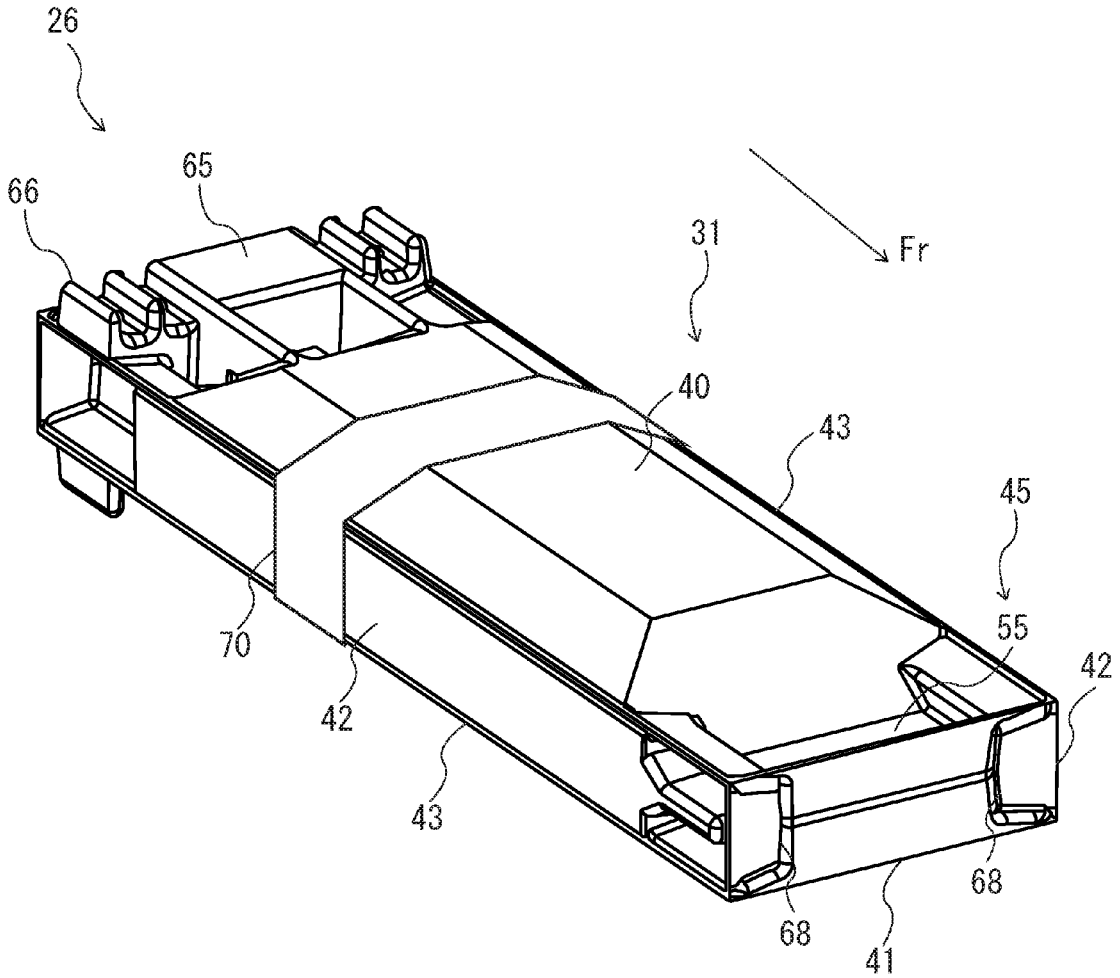
FIG. 19 is a front perspective view showing the ink container in a state, where a label is wound, applied to the printer according to the embodiment of the present disclosure.
Figure 20:
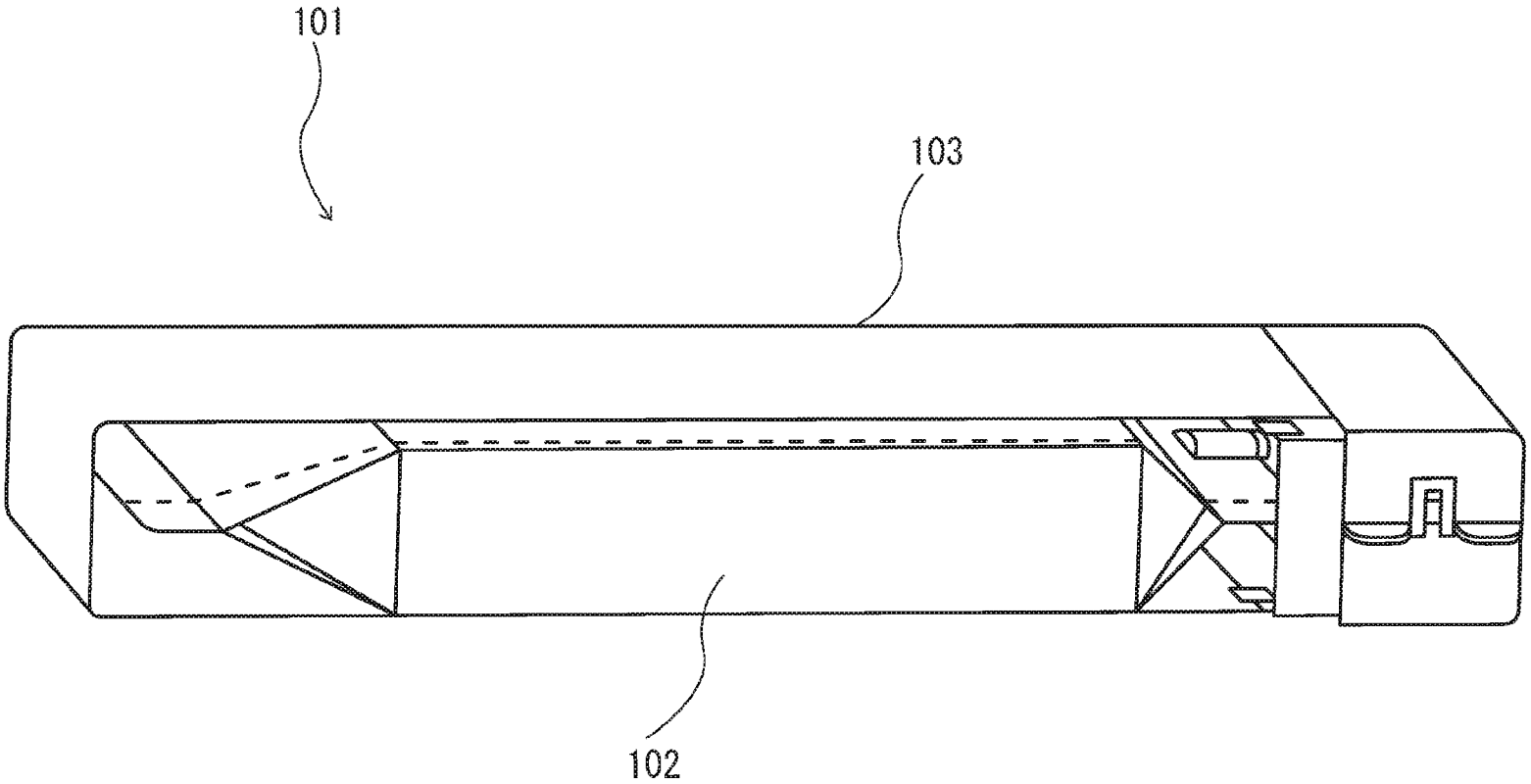
FIG. 20 Related Art
FIG. 20 is a sectional view showing an ink container along forward and backward directions in a state, where an ink is filled in an ink pack.
Figure 21:
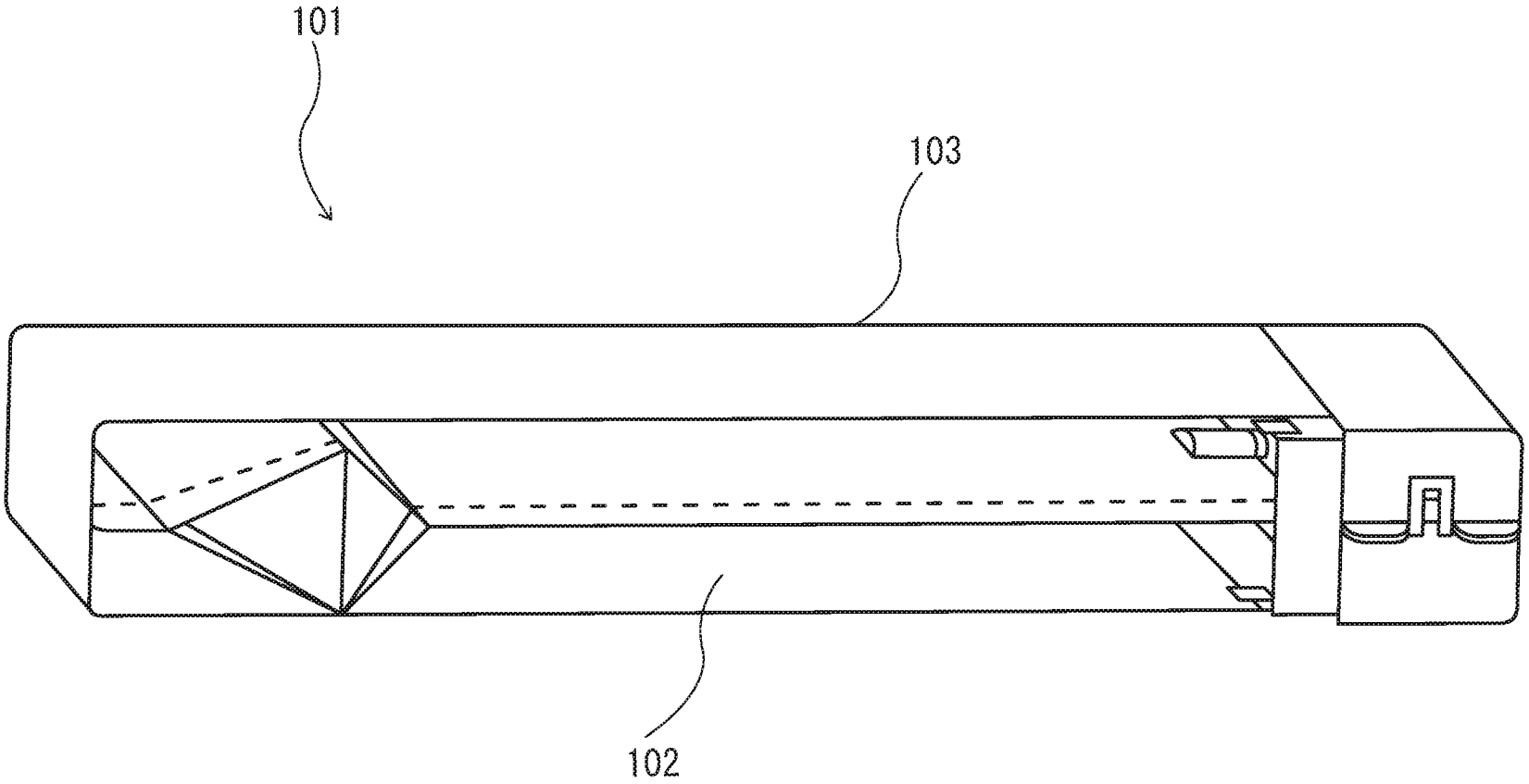
FIG. 21 Related Art
FIG. 21 is a sectional view showing an ink container along forward and backward directions in a state, where an ink pack is finished.

Incidentally, although, in the above-described embodiment, the construction of maintaining the assembled state of the container case 31 by the engaging protrusion 61 and the engaging depression 62, such as snap-fit, was described, in another embodiment, in place of the engaging protrusion 61 and the engaging depression 62 or in addition to the engaging protrusion 61 and the engaging depression 62, for example, as shown in FIG. 19, a sealing member, such as a label 70, may be attached (wound) around both sides of the container case 31. In this manner, the assembled state of the container case 31 can be fixed merely by winding the label 70, and thereby, it is possible to enhance the user operability. Also, since the label 70 allows to write the information related to the ink container 26 or the ink of the ink pack 30, it is possible to enhance the visibility of information for the user. Further, since the assembled state of the container case 31 is fixed by the label 70, it is possible to prevent disassembling of the container case 31 by incorrect operation of the user.

Although as the embodiment, configurations of the disclosure are applied to the printer 1 as the inkjet image forming apparatus, as a different embodiment, the ideas of the disclosure may be applied to a different inkjet image forming apparatus, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An ink container comprising:

an ink pack to be filled with an ink; and a container case housing the ink pack, wherein the container case includes:

an upper plate and a lower plate respectively covering the ink pack from an upper side and a lower side;

at least one side plate provided between side parts of the upper plate and the lower plate; and at least two hinges coupling the upper plate and the lower plate with the side plate to each other, and wherein the upper plate, the lower plate, the side plate and the hinges are integrally molded, and the upper plate, the lower plate and the side plate are bent by the hinges so as to be thereby assembled as the container case including a housing configured to house the ink pack at a center, and one ends of the upper plate and the lower plate constitute a grip, and other ends of the upper plate and the lower plate constitutes an aperture.

2. The ink container according to claim 1, wherein the container case includes a spout fixing part fixing a spout of the ink pack at a side of the other end in an assembled state, and the lower plate includes an ink reception at the side of the other end from the spout fixing part.

3. The ink container according to claim 1, wherein the container case includes a spout fixing part fixing a spout of the ink pack at a side of the other end in an assembled state, and the upper plate includes an RFID attaching part at the side of the other end from the spout fixing part.

4. The ink container according to claim 1, wherein the upper plate and the lower plate are configured, in a state in which the container case has been assembled, so that respective one end sides constituting the grip are spaced to face each other and constitute an expansion housing configured to house expansion of the ink pack according to a decrease of the ink.

5. The ink container according to claim 1, wherein the upper plate is formed so that a bottom face constituting the housing has a plane part and first inclined parts continuing from the plane part and being inclined downward toward a side of the one end and a side of the other end, and the lower plate is formed so that a top face constituting the housing has a plane part and first inclined parts continuing from the plane part and being inclined upward toward the side of the one end and the side of the other end.

6. The ink container according to claim 5, wherein the upper plate has a fixing depression continuing from a first inclined part at a side of the other end of a bottom face and being protruded on the bottom face, the lower plate has a fixing depression continuing from a first inclined part at a side of the other end of a top face and being protruded on the top face, and the fixing depression of the upper plate and the fixing depression of the lower plate are provided as a pair of an upper portion and a lower portion and constitute a spout fixing part fixing a spout of the ink pack in an assembled state.

7. The ink container according to claim 1, wherein the upper plate is formed so that a bottom face constituting the housing has a plane part and second inclined parts continuing from the plane part and being inclined downward toward both sides, and the lower plate is formed so that a top face constituting the housing has a plane part and second inclined parts continuing from the plane part and being inclined upward toward both sides.

8. The ink container according to claim 1, wherein the upper plate and the lower plate respectively includes engaging portions configured to engage with each other.

9. The ink container according to claim 8, wherein the engaging portions of the upper plate and the lower plate are constructed with a snap-fit.

10. The ink container according to claim 1, wherein the container case includes a label to be wound around both side parts.

11. The ink container according to claim 1, wherein the upper plate, the lower plate, the side plate and the hinges are made of plastics having transparency.

12. The ink container according to claim 1, wherein the upper plate has a gripping depression formed at a side of the one end of a top face, the lower plate has a gripping depression formed at a side of the one end of a bottom face, and the gripping depression of the upper plate and the gripping depression of the lower plate are provided as a pair of an upper portion and a lower portion and constitute the grip.

13. An inkjet image forming apparatus comprising the ink container according to claim 1.

* * * * *